US008663890B2

(12) United States Patent
Takagi et al.

(10) Patent No.: US 8,663,890 B2
(45) Date of Patent: Mar. 4, 2014

(54) ELECTROSTATIC CHARGE IMAGE DEVELOPING TONER AND MANUFACTURING METHOD THEREOF, ELECTROSTATIC CHARGE IMAGE DEVELOPER, TONER CARTRIDGE, PROCESS CARTRIDGE, IMAGE FORMING APPARATUS, AND IMAGE FORMING METHOD

(75) Inventors: Shinpei Takagi, Kanagawa (JP); Soichiro Kitagawa, Kanagawa (JP); Shinya Sakamoto, Kanagawa (JP); Tomohiro Shinya, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 0 days.

(21) Appl. No.: 13/541,384

(22) Filed: Jul. 3, 2012

(65) Prior Publication Data

US 2013/0183618 A1 Jul. 18, 2013

(30) Foreign Application Priority Data

Jan. 12, 2012 (JP) ..... 2012-004382

(51) Int. Cl.
*G03G 9/08* (2006.01)
*G03G 9/087* (2006.01)

(52) U.S. Cl.
USPC ..... 430/110.2; 430/137.15

(58) Field of Classification Search
USPC ..... 430/110.2, 137.15
See application file for complete search history.

(56) References Cited

U.S. PATENT DOCUMENTS

| | | | | |
|---|---|---|---|---|
| 5,536,612 | A | 7/1996 | Yamaguchi et al. | |
| 6,326,117 | B1 * | 12/2001 | Ishihara | 430/110.2 |
| 2006/0088782 | A1 | 4/2006 | Lee et al. | |
| 2009/0035686 | A1 * | 2/2009 | Sacripante | 430/110.2 |
| 2009/0155700 | A1 * | 6/2009 | Pang et al. | 430/48 |

FOREIGN PATENT DOCUMENTS

| | | |
|---|---|---|
| JP | A-4-86828 | 3/1992 |
| JP | A-6-317925 | 11/1994 |
| JP | A-8-286416 | 11/1996 |
| JP | A-2004-294839 | 10/2004 |
| JP | A-2006-119652 | 5/2006 |
| JP | A-2006-178093 | 7/2006 |
| JP | A-2007-86459 | 4/2007 |

* cited by examiner

*Primary Examiner* — Hoa V Le
(74) *Attorney, Agent, or Firm* — Oliff PLC

(57) ABSTRACT

Provided is an electrostatic charge image developing toner, each toner particle including a core portion, a first shell layer, and a second shell layer, wherein the core portion contains a first polyester resin, a colorant, and a release agent, the first shell layer contains a second polyester resin and covers the core portion, the second shell layer contains a polymer of an aromatic vinyl monomer and a third polyester resin having an ethylenic unsaturated double bond that is polymerizable with the aromatic vinyl monomer, and covers the first shell layer, and a total amount of the first shell layer and the second shell layer is within a range of from 16% by weight to 40% by weight of the toner particle.

18 Claims, 2 Drawing Sheets

ELECTROSTATIC CHARGE IMAGE DEVELOPING TONER AND MANUFACTURING METHOD THEREOF, ELECTROSTATIC CHARGE IMAGE DEVELOPER, TONER CARTRIDGE, PROCESS CARTRIDGE, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2012-004382 filed Jan. 12, 2012.

BACKGROUND

1. Technical Field

The present invention relates to an electrostatic charge image developing toner and a manufacturing method thereof, an electrostatic charge image developer, a toner cartridge, a process cartridge, an image forming apparatus, and an image forming method.

2. Related Art

In recent years, image forming apparatuses such as a printer and a copying machine have become widespread, and technologies related to various elements making up the image forming apparatuses have become widespread. Among the image forming apparatuses, in an image forming apparatus adopting an electrophotographic type, frequently, a photoreceptor including a photoreceptor (image holding member) is charged using a charging device, and an electrostatic charge image having a potential different from an ambient potential is formed on the charged photoreceptor to form a pattern that is desired to be printed. The electrostatic charge image that is formed in this manner is developed with toner and is ultimately transferred onto a transfer medium such as a recording paper.

SUMMARY

According to an aspect of the invention, there is provided an electrostatic charge image developing toner, each toner particle including a core portion, a first shell layer, and a second shell layer, in which the core portion contains a first polyester resin, a colorant, and a release agent, the first shell layer contains a second polyester resin and covers the core portion, the second shell layer contains a polymer of an aromatic vinyl monomer and a third polyester resin having an ethylenic unsaturated double bond that is polymerizable with the aromatic vinyl monomer, and covers the first shell layer, and a total amount of the first shell layer and the second shell layer is within a range of from 16% by weight to 40% by weight of the toner particle.

BRIEF DESCRIPTION OF THE DRAWINGS

Exemplary embodiments of the present invention will be described in detail based on the following figures, wherein.

DETAILED DESCRIPTION

Figure 1:
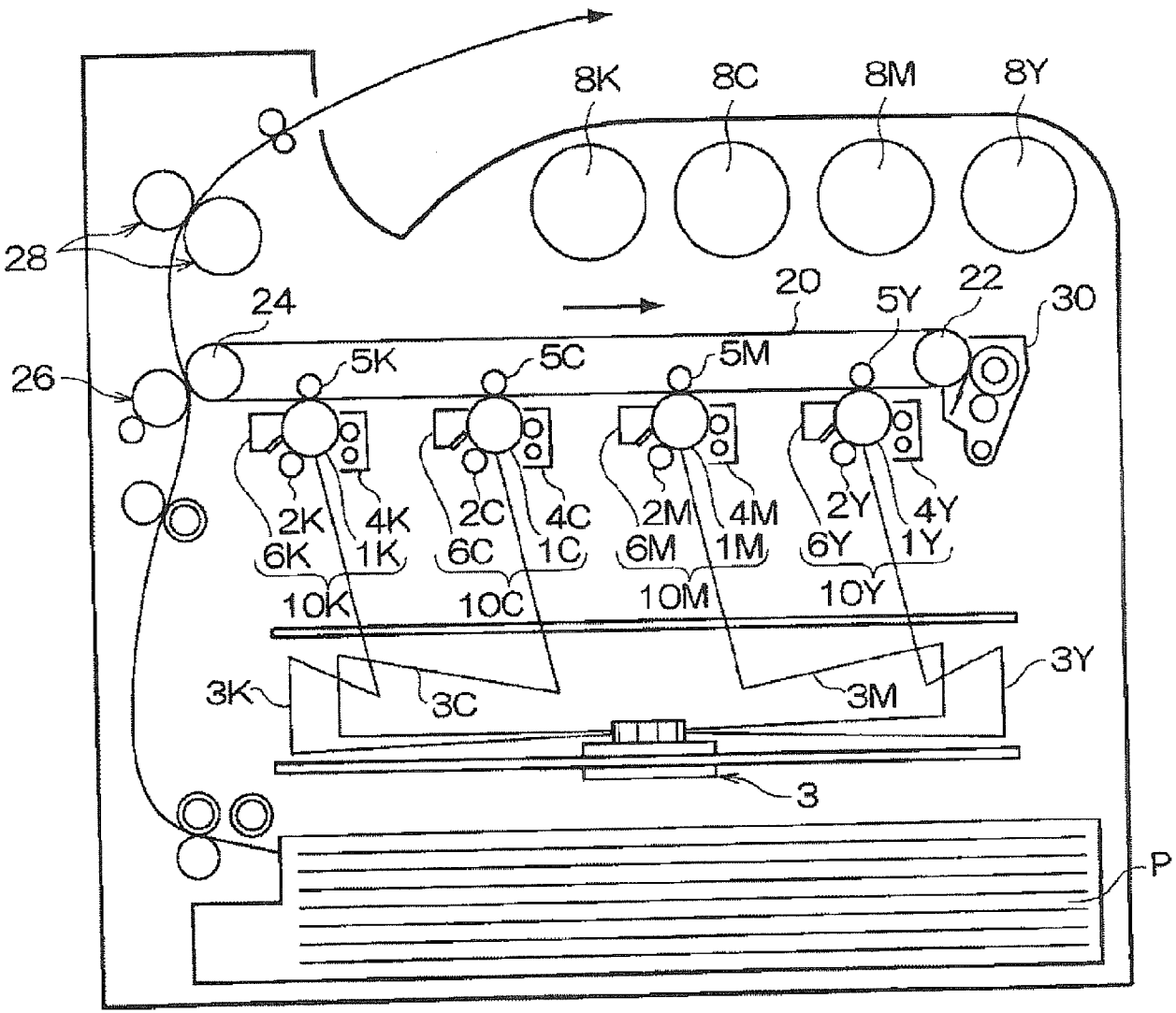
FIG. 1 is a schematic configuration diagram illustrating an example of an image forming apparatus according to an exemplary embodiment.

Hereinafter, exemplary embodiments of an electrostatic charge image developing toner and a manufacturing method thereof, an electrostatic charge image developer, a toner cartridge, a process cartridge, an image forming apparatus, and an image forming method of the invention will be described in detail.

Electrostatic Charge Image Developing Toner and Manufacturing Method thereof.

The electrostatic charge image developing toner of this exemplary embodiment (hereinafter, may be referred to simply as a "toner") is an electrostatic charge image developing toner, each toner particle including a core portion, a first shell layer, and a second shell layer. The core portion contains a first polyester resin, a colorant, and a release agent. The first shell layer contains a second polyester resin and covers the core portion. The second shell layer contains a polymer of an aromatic vinyl monomer and a third polyester resin (hereinafter, may be referred to as "unsaturated polyester resin") having an ethylenic unsaturated double bond that is polymerizable with the aromatic vinyl monomer, and covers the first shell layer. A total amount of the first shell layer and the second shell layer is within a range of from 16 to 40% by weight of the toner particle.

To realize compatibility between low power consumption and instant-on fixing, and to obtain a toner having a sufficient low-temperature fixing property, there is disclosed a technology in which the toner contains a sharp-melt crystalline resin as a binder resin so as to obtain the above-described characteristics. On the other hand, toner aggregates are formed due to heat and stress of an auger in a transporting path from a toner cartridge to a developer unit under a high-temperature and high-humidity environment, and thus a transportability or the like may be deteriorated. There is also disclosed a method in which surfaces of toner particles are coated with a resin having a high glass transition temperature so as to obtain heat resistance and stress resistance, but in the method of the related art, a uniform thin film is difficult to obtain. Therefore, it is necessary to make the film thick and thus a low-temperature fixing property may be deteriorated.

The toner according to this exemplary embodiment is excellent in the transportability. Although not clear, this reason is thought to be as described below.

The second shell layer making up the outermost layer of the toner contains the polymer of the aromatic vinyl monomer and the third polyester resin having the ethylenic unsaturated double bond that is polymerizable with the aromatic vinyl monomer. When the polymer is present in the outermost layer of the toner, the heat resistance and the stress resistance of the toner are improved. Therefore, the heat resistance and the stress resistance of the toner are exhibited in the transporting path from the toner cartridge to the developer unit, and thus the formation of the aggregates of the toner is suppressed. As a result, toner clogging does not occur and thus it is thought that the transportability of the toner is improved.

Hereinafter, each component making up the toner of this exemplary embodiment will be described.

Polyester Resin

In this exemplary embodiment, as the first polyester resin and the second polyester resin, an amorphous polyester resin is appropriately used. In addition, a crystalline polyester resin may be used in combination in the core portion as necessary.

Crystalline Polyester Resin

A melting temperature of the crystalline polyester resin that is used in this exemplary embodiment is preferably within a range of from 50° C. to 100° C., more preferably within a range of from 55° C. to 90° C., and even more preferably within a range of from 60° C. to 85° C. from the viewpoints of a storage property and a low-temperature fixing property. When the melting temperature exceeds 50° C., deterioration of a toner storage property such as blocking occurring in the stored toner, or deterioration in a storage property of a fixed image after fixing does not occur. In addition, when the melting temperature is 100° C. or lower, a sufficient low-temperature fixing property may be obtained.

In addition, the melting temperature of the crystalline polyester resin is obtained as the peak temperature of an endothermic peak that is obtained by differential scanning calorimetry (DSC).

In this exemplary embodiment, the "crystalline polyester resin" also represents a polymer whose constituent components have a 100% polyester structure and additionally a polymer (copolymer) that is obtained by polymerizing the components making up the polyester together with other components. However, in the latter case, components that make up the polymer (copolymer) other than the polyester are 50% by weight or less.

The crystalline polyester resin, which is used for the toner particles of this exemplary embodiment, is synthesized from, for example, a polyvalent carboxylic acid component and a polyol component. In addition, in this exemplary embodiment, as the crystalline polyester resin, commercially-available products may be used, or synthesized resins may be used.

Examples of the polyvalent carboxylic acid component include, but are not limited to, aliphatic dicarboxylic acids such as oxalic acid, succinic acid, glutaric acid, adipic acid, speric acid, azelaic acid, sebacic acid, 1,9-nonanedicarboxylic acid, 1,10-decanedicarboxylic acid, 1,12-dodecanedicarboxylc acid, 1,14-tetradecanedicarboxylic acid, and 1-18-octadecanedicarboxylic acid; aromatic dicarboxylic acids including a dibasic acid such as phthalic acid, isophthalic acid, terephthalic acid, naphthalene-2,6-dicarboxylic acid, malonic acid, and mesaconic acid; and anhydrides and lower alkyl esters thereof.

Examples of a trivalent or higher carboxylic acid include a specific aromatic carboxylic acid such as 1,2,3-benzenetricarboxylic acid, 1,2,4-benzenetricarboxylic acid, and 1,2,4-naphthalenetricarboxylic acid, and anhydrides, and lower alkyl esters thereof. One kind of these may be used alone, or two or more kinds thereof may be used in combination.

In addition, as an acid component, in addition to the aliphatic dicarboxylic acid or the aromatic dicarboxylic acid, a dicarboxylic component having a sulfonic acid group may be contained.

As the polyol component, an aliphatic diol is preferable, and a straight chain type aliphatic diol in which a carbon number of a main chain portion is from 7 to 20 is more preferable. When the aliphatic diol is the straight chain type, crystallinity of the polyester resin is improved, and the melting temperature is increased. In addition, when the carbon number in the main chain portion is 7 or more, in a case of being subjected to condensation polymerization with the aromatic dicarboxylic acid, the melting temperature is lowered and thus the low-temperature fixing becomes easy. On the other hand, when the carbon number in the main chain portion is 20 or less, a material in practical use is easily available. As the carbon number of the main chain portion, 14 or less is more preferable.

Specific examples of the aliphatic diol appropriately used for the synthesis of the crystalline polyester that is used for the toner particles according to this exemplary embodiment include, but are not limited to, ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, 1,14-eicosanedecanediol, and the like. Among these, 1,8-octanediol, 1,9-nonanediol, and 1,10-decanediol are preferred in view of easy availability.

Examples of trihydric or higher alcohols include glycerol, trimethylolethane, trimethylolpropane, pentaerythritol, and the like. One kind of these alcohols may be used alone, or two or more kinds thereof may be used in combination.

The content of the aliphatic diol component in the polyol component is preferably 80 mol % or more, and more preferably 90 mol % or more. When the content of the aliphatic diol component is 80 mol % or more, the crystallinity of the polyester resin is improved, and the melting temperature is increased, whereby the toner blocking resistance, and the image storage stability are improved.

In addition, the polyvalent carboxylic acid or the polyol may be added at the final stage of the synthesis for the purpose of adjusting an acid value or a hydroxyl group value, or the like, as necessary. Examples of the polyvalent carboxylic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenylsuccinic anhydride, or adipic acid; alicyclic carboxylic acids such as cyclohexanedicarboxylic acids; and aromatic carboxylic acids having at least 3 carboxyl groups in one molecule, such as 1,2,4-benzenetricarboxylic acid, 1,2,5-benzenetricarboxylic acid, or 1,2,4-naphthalenetricarboxylic acid.

Example of the polyol include aliphatic diols such as ethylene glycol, diethylene glycol, triethylene glycol, propylene glycol, butanediol, hexanediol, neopentyl glycol, and glycerol; alicyclic diols such as cyclohexanediol, cyclohexane dimethanol, and hydrogenated bisphenol A; and aromatic diols such as ethylene oxide adducts of bisphenol A and propylene oxide adducts of bisphenol A.

The crystalline polyester resin may be prepared at a polymerization temperature of from 180° C. to 230° C., and the reaction is carried out in a reaction system which is decompressed as necessary, while water and alcohol generated during condensation are removed.

When a polymerizable monomer is insoluble or incompatible at the reaction temperature, a high boiling point solvent may be added as a solubilizing agent to dissolve the insoluble or incompatible polymerizable monomer. In this case, a polycondensation reaction is carried out with the solubilizing solvent being removed by evaporation. When a polymerizable monomer having poor compatibility is present in a copolymerization reaction, the polymerizable monomer having poor compatibility may be previously condensed with an acid or alcohol that is to be polycondensed with the polymerizable monomer, and then be polycondensed with the main component.

The acid value of the crystalline polyester resin used in this exemplary embodiment of the invention (the number of milligrams of KOH necessary to neutralize 1 g of resin) is preferably in the range of from 3.0 mg KOH/g to 30.0 mg KOH/g, more preferably in the range of from 6.0 mg KOH/g to 25.0 mg KOH/g, even more preferably in the range of from 8.0 mg KOH/g to 20.0 mg KOH/g. In this exemplary embodiment, the acid value is measured in accordance with JIS K-0070-1992.

When the acid value is higher than 3.0 mg KOH/g, dispersibility in water is improved, and thus preparation of the emulsification particles by a wet process becomes easy. Furthermore, since the stability as emulsification particles during aggregation is improved, the toner may be effectively manufactured with ease. On the other hand, when the acid value is equal to or lower than 30.0 mg KOH/g, the moisture absorption property of the toner does not increase, and it is difficult for the toner to become susceptible to environmental effects.

In addition, the weight-average molecular weight (Mw) of the crystalline polyester resin is preferably from 6,000 to 35,000. When the molecular weight (Mw) is 6,000 or more, the toner may not penetrate into the surface of a recording medium such as paper during fixation and thus does not cause uneven fixation, or the strength of the fixed image for bending resistance does not decrease. On the other hand, when the weight-average molecular weight (Mw) is 35,000 or less, since a viscosity at the time of being melted is not so high, a temperature for achieving a viscosity suitable for fixation does not increase, whereby the low-temperature fixing property may be obtained.

The weight-average molecular weight may be measured by gel permeation chromatography (GPC). The molecular weight measurement by GPC is carried out using a GPC HLC-8120 manufactured by Tosoh Corporation as a measuring apparatus, and a TSK gel Super HM-M column (15 cm) manufactured by Tosoh Corporation and THF solvent are used. The weight-average molecular weight is calculated from the measurement results using a molecular weight calibration curve that is created with monodispersed polystyrene standard samples.

The content of the crystalline resin in the toner particle is preferably in the range of from 3% by weight to 40% by weight, more preferably in the range of from 4% by weight to 35% by weight, and even more preferably in the range of from 5% by weight to 30% by weight.

The crystalline resin including the above-described crystalline polyester resin preferably includes a crystalline polyester resin (hereinafter, also referred to as a "crystalline aliphatic polyester resin"), which is synthesized using an aliphatic monomer, as a main component (50% by weight or more). Furthermore, in this case, the constituent ratio of the aliphatic monomer making up the crystalline aliphatic polyester resin is preferably 60 mol % or more, and more preferably 90 mol % or more. As the aliphatic monomer, the above-described aliphatic diols or dicarboxylic acids may be appropriately used.

In addition, in this exemplary embodiment, as the crystalline resin, a polyalkylene resin, a long-chain alkyl (meth) acrylate resin, and the like may be used in combination.

Amorphous Polyester Resin

In this exemplary embodiment, when the amorphous polyester resin is used, compatibility with the crystalline polyester resin is improved. Therefore, accompanying the decrease in the viscosity of the crystalline polyester resin at the melting temperature, the viscosity of the amorphous polyester resin also decreases, and a sharp-melt property (a sharp melting property) as a toner is obtained, which is advantageous to a low-temperature fixing property. Furthermore, the amorphous polyester resin is excellent in wettability with a crystalline polyester resin, and thus dispersibility of the crystalline polyester resin to the inside of the toner is improved. Therefore, the exposure of the crystalline polyester resin to the surface of the toner is suppressed, and thus an adverse effect on the charging characteristics is suppressed. On this account, the amorphous polyester resin is preferable also from the viewpoints of improvement in the strength of the toner and fixed image.

The amorphous polyester resin, which is preferably used in this exemplary embodiment, is obtained by, for example, condensation polymerization of polyvalent carboxylic acids with polyols.

Examples of the polyvalent carboxylic acid include aromatic carboxylic acids such as terephthalic acid, isophthalic acid, phthalic anhydride, trimellitic anhydride, pyromellitic acid, and naphthalenedicarboxylic acid; aliphatic carboxylic acids such as maleic anhydride, fumaric acid, succinic acid, alkenylsuccinic anhydride, and adipic acid; and alicyclic carboxylic acids such as cyclohexanedicarboxylic acid. One or two or more of these polyvalent carboxylic acids may be used. Among these polyvalent carboxylic acids, it is preferable to use an aromatic carboxylic acid. In addition, it is preferable to have a cross-linked structure or a branched structure so as to obtain a preferable fixing property, and thus it is preferable to use a trivalent or higher carboxylic acid (trimellitic acid or an anhydride thereof) in combination with a dicarboxylic acid.

Examples of the polyol in the amorphous polyester resin include aliphatic diols such as ethylene glycol, diethylene glycol, triethylene glycol, propylene glycol, butanediol, hexanediol, neopentyl glycol, and glycerol; alicyclic diols such as cyclohexanediol, cyclohexanedimethanol, and hydrogenated bisphenol A; and aromatic diols such as ethylene oxide adducts of bisphenol A and propylene oxide adducts of bisphenol A. One or two or more of these polyols may be used. Among these polyols, the aromatic diols and alicyclic diols are preferable, and the aromatic diols are more preferable. It is preferable to have a cross-linked structure or a branched structure so as to obtain a preferable fixing property, and thus a trivalent or higher polyol (glycerol, trimethylolpropane, or pentaerythritol) may be used in combination with a diol.

In this exemplary embodiment, as the constituent component of the amorphous polyester resin, it is preferable that alkenylsuccinic acid or anhydride thereof be contained. When the amorphous polyester resin containing alkenylsuccinic acid or the anhydride thereof as the constituent component is used, compatibility with the crystalline resin is improved, and thus a preferable low-temperature fixing property may be obtained. As the alkenylsuccinic acid, dodecenylsuccinic acid, octylsuccinic acid, or the like is used.

The glass transition temperature (Tg) of the amorphous polyester resin is preferably in the range of from 50° C. to 80° C. When Tg is 50° C. or higher, the storage stability of the toner or the storage stability of the fixed image is improved. On the other hand, when Tg is 80° C. or lower, fixation may be performed at a lower temperature compared to the related art.

Tg of the amorphous polyester resin is more preferably in the range of from 50° C. to 65° C.

The glass transition temperature of the amorphous polyester resin may be determined as the peak temperature of an endothermic peak that is obtained by differential scanning calorimetry (DSC).

The content of the amorphous resin in the toner particle is preferably in the range of from 40% by weight to 95% by weight, more preferably in the range of from 50% by weight to 90% by weight, and even more preferably in the range of from 60% by weight to 85% by weight.

Preparation of the amorphous polyester resin may be carried out in accordance with the preparation of the crystalline polyester resin described above.

In addition, the weight-average molecular weight (Mw) of the amorphous polyester resin is preferably from 30,000 to 80,000. When the molecular weight (Mw) is from 30,000 to 80,000, the shape of the toner is controlled, and thus a potato shape is realized. Furthermore, high-temperature offset resistance may be obtained.

The weight-average molecular weight (Mw) of the amorphous polyester resin is more preferably from 35,000 to 80,000, and even more preferably from 40,000 to 80,000.

In addition, in this exemplary embodiment, as the amorphous resin, known resin materials such as a styrene/acrylic resin, an epoxy resin, a polyurethane resin, a polyamide resin, a cellulose resin, a polyether resin, and a polyolefin resin may be used in combination.

In this exemplary embodiment, as a binder resin, the crystalline polyester resin and the amorphous polyester resin are preferably used in combination.

Unsaturated Polyester Resin

In this exemplary embodiment, the unsaturated polyester resin forms a polymer together with an aromatic vinyl monomer to be described later and makes up the second shell layer.

The unsaturated polyester resin that is used in this exemplary embodiment may be an amorphous unsaturated polyester resin.

The amorphous unsaturated polyester resin is an amorphous polyester resin having an unsaturated group (for example, a vinyl group or vinylene group) as an unsaturated polyester component.

Specifically, for example, the amorphous unsaturated polyester resin is a condensation polymer of the polyvalent carboxylic acid and the polyol, and a monomer having an unsaturated group (for example, a vinyl group or vinylene group) that becomes an unsaturated polyester component may be used as at least one of the polyvalent carboxylic acid and the polyol.

Particularly, from the viewpoints of stability, as the amorphous unsaturated polyester resin, a condensation polymer of the polyvalent carboxylic acid having an unsaturated group (for example, a vinyl group or vinylene group) and the polyol is preferable, and as the amorphous unsaturated polyester resin, a condensation polymer (that is, a straight-chain polyester resin) of a bivalent carboxylic acid having the unsaturated group (for example, a vinyl group or vinylene group) and a bivalent alcohol is preferable.

Examples of the bivalent carboxylic acid having the unsaturated group (for example, a vinyl group or vinylene group) includes fumaric acid, maleic acid, maleic anhydride, citraconic acid, mesaconic acid, itaconic acid, glutaconic acid, allylmalonic acid, isopropylidenesuccinic acid, acetylenedicarboxylic acid, and lower alkyl esters (having a carbon number of from 1 to 4) thereof.

Examples of a trivalent or higher carboxylic acid having an unsaturated group (for example, a vinyl group or vinylene group) includes aconitic acid, 3-butene-1,2,3-tricarboxylic acid, 4-pentene-1,2,4-tricarboxylic acid, 1-pentene-1,1,4,4,-tetracarboxylic acid, and lower alkyl esters (having a carbon number of from 1 to 4) thereof.

One kind of these polyvalent carboxylic acids may be used alone, or two or more kinds thereof may be used in combination.

Examples of the bivalent alcohol include bisphenol A, hydrogenated bisphenol A, ethylene oxide and/or propylene oxide adducts of bisphenol A, 1,4-cyclohexanediol, 1,4-cyclohexanedimethanol, ethylene glycol, diethylene glycol, propylene glycol, dipropylene glycol, 1,3-butanediol, 1,4-butanediol, 1,5-pentanediol, 1,6-hexanediol, 1,9-nonanediol, neopentyl glycol, and the like.

Examples of trihydric or higher alcohols include glycerol, trimethylolethane, trimethylolpropane, pentaerythritol, and the like.

In addition, a monovalent acid such as acetic acid and benzoic acid, or a monohydric alcohol such as cyclohexanol and benzyl alcohol may be used in combination with the polyols for the purpose of adjusting an acid value or a hydroxyl group value, or the like, as necessary.

One kind of these polyols may be used alone, or two or more kinds thereof may be used in combination.

Among amorphous unsaturated polyester resins that are condensation polymers of the polyvalent carboxylic acid and the polyol, particularly, a condensation polymer of at least one kind of bivalent carboxylic acid selected from fumaric acid, maleic acid, and maleic anhydride, and dihydric alcohol is preferable.

That is, it is preferable that an unsaturated polyester component of the amorphous unsaturated polyester resin be a component that is derived from at least one kind of bivalent carboxylic acid selected from fumaric acid, maleic acid, and maleic anhydride.

The component, which is derived from at least one kind of bivalent carboxylic acid selected from fumaric acid, maleic acid, and maleic anhydride, has high reactivity with an aromatic vinyl monomer, and is polymerized with the vinyl monomer to form the second shell layer. According to the toner, which includes the second shell layer containing the polymer of the aromatic vinyl monomer and the unsaturated polyester resin, of this exemplary embodiment, glossiness of a fixed image is improved easily.

A method of preparing the amorphous unsaturated polyester resin is not particularly limited and may be carried out in accordance with the preparation of the crystalline polyester resin described above.

For example, the weight-average molecular weight (Mw) of the amorphous unsaturated polyester resin is preferably from 30,000 to 300,000, more preferably from 30,000 to 200,000, and even more preferably from 35,000 to 150,000.

For example, the glass transition temperature (Tg) of the amorphous unsaturated polyester resin is preferably from 50° C. to 80° C., and more preferably from 50° C. to 65° C.

The glass transition temperature of the amorphous unsaturated polyester resin may be determined as the peak temperature of an endothermic peak that is obtained by differential scanning calorimetry (DSC).

Aromatic Vinyl Monomer

In this exemplary embodiment, the aromatic vinyl monomer forms a polymer together with the above-described unsaturated polyester resin and this resultant polymer makes up the second shell layer.

Examples of the aromatic vinyl monomer that is used in this exemplary embodiment include a styrene monomer, vinyl toluene, vinyl carbazole, vinyl naphthalene, vinyl anthracene, 1,1-diphenylethylene, and the like.

Here, examples of the styrene monomer include styrene, alkyl-substituted styrene (for example, α-methylstyrene, vinyl naphthalene, 2-methylstyrene, 3-methylstyrene, 4-methylstyrene, 2-ethylstyrene, 3-ethylstyrene, 4-ethylstyrene, and the like), halogen-substituted styrenes (for example, 2-chlorostyrene, 3-chlorostyrene, 4-chlorostyrene, and the like), divinyl benzene, and the like.

In this exemplary embodiment, as the aromatic vinyl monomer, styrene is more preferable.

Colorant

The core particles of the toner of this exemplary embodiment contain a colorant. The colorant that is used in this exemplary embodiment may be either a pigment or dye, but the pigment is preferable from the viewpoints of light resistance or water resistance.

Preferable examples of the colorant include known pigments such as carbon black, aniline black, aniline blue, calco oil blue, chrome yellow, ultramarine blue, DuPont oil red, quinoline yellow, methylene blue chloride, phthalocyanine blue, malachite green oxalate, lamp black, rose bengal, quinacridone, benzidine yellow, 0.1. Pigment Red 48:1, C.I. Pigment Red 57:1, C.I. Pigment Red 122, C.I. Pigment Red 185, C.I. Pigment Red 238, C.I. Pigment Yellow 12, C.I. Pigment Yellow 17, C.I. Pigment Yellow 180, C.I. Pigment Yellow 97, C.I. Pigment Yellow 74, C.I. Pigment Blue 15:1, and C.I. Pigment Blue 15:3.

The content of the colorant in the toner of this exemplary embodiment is preferably in the range of from 1 part by weight to 30 parts by weight based on 100 parts by weight of the entire resins contained in the toner particles. It is also effective to use a colorant whose surface is treated as necessary, or a pigment dispersant. By selecting the type of the colorant, a yellow toner, a magenta toner, a cyan toner, a black toner, and the like may be obtained.

Release Agent

The core particles of the toner of this exemplary embodiment contain a release agent. Examples of the release agent include paraffin wax such as low molecular weight polypropylene and low molecular weight polyethylene; a silicone resin; rosins; rice wax; carnauba wax; and the like. The melting temperature of this release agent is preferably from 50° C. to 100° C., and more preferably from 60° C. to 95° C. The content of the release agent in the toner is preferably from 0.5% by weight to 15% by weight, more preferably from 1.0% by weight to 12% by weight. When the content of the release agent is less than 0.5% by weight, a peeling defect may occur particularly in oilless fixing. When the content of the release agent is more than 15% by weight, the reliability of the image quality and image formation may be decreased due to the deterioration of the toner flowability and the like.

Other Additives

In addition to the above-described components, an internal additive, various components such as a charge-controlling agent, inorganic granular materials (inorganic particles), and organic particles may be added to the core particles of this exemplary embodiment as necessary.

Examples of the internal additive include metals such as ferrite, magnetite, reduced iron, cobalt, nickel, and manganese, alloys thereof, and magnetic substances such as a compound containing these metals.

The inorganic particles are added for various purposes and may be added for adjustment of the viscoelasticity of the toner. By adjusting the viscoelasticity, image glossiness and penetration of the toner into paper may be adjusted. As the inorganic particles, known inorganic particles such as silica particles, titanium oxide particles, alumina particles, and cerium oxide particles, or particles whose surface is subjected to hydrophobic treatment may be used. One kind of these inorganic particles may be used alone, or two or more kinds thereof may be used in combination. Among these, silica particles having a lower refractive index than that of the binder resin are preferably used from the viewpoints of preventing deterioration in a chromogenic property and transparency such as an OHP transmission property. The silica particles may be subjected to various kinds of surface treatments. For example, silica particles whose surface is treated with a silane coupling agent, a titanium coupling agent, or silicone oil are preferably used.

Structure of Toner Particle

The toner particle of this exemplary embodiment includes a core portion containing a first polyester resin, a colorant, and a release agent. The core portion is coated with a first shell layer containing a second polyester resin. The first shell layer is coated with a second shell layer containing a polymer of an aromatic vinyl monomer and an unsaturated polyester resin.

In this exemplary embodiment, a total amount of the first shell layer and the second shell layer is within a range of from 16% by weight to 40% by weight of the toner particle. When the total amount is less than 16% by weight, the colorant or the release agent may be exposed to a surface of the toner and thus a problem such as deterioration in powder flowability and charging may occur easily. On the other hand, when the total amount exceeds 40% by weight, it is difficult for the release agent to bleed out during fixation, and thus it is difficult for the toner to be released from a fixing member, thereby easily causing a problem in that offset occurs easily.

The total amount of the first shell layer and the second shell layer is more preferably from 20% by weight to 35% by weight of the toner particles.

In this embodiment, it is preferable that the first polyester resin contained in the core portion and the second polyester resin contained in the first shell layer be polyester resins that do not have the ethylenic unsaturated double bond that is polymerizable with the aromatic vinyl monomer. When the polyester resins, which do not have the ethylenic unsaturated double bond that is polymerizable with the aromatic vinyl monomer, are used for the first polyester resin contained in the core portion and the second polyester resin contained in the first shell layer, the polymerization reaction of the polyester resin due to the aromatic vinyl monomer may be suppressed and as a result, the surface layer (that is, the second shell layer) of the toner contains the polymer. In this case, the strength of the surface layer of the toner may be improved without improving the strength of the inside (that is, the core portion and the first shell layer) of the toner particles. Therefore, due to this structure, the toner in which the fixing property (the low-temperature fixing property) is not deteriorated may be formed.

In this exemplary embodiment, it is preferable that the glass transition temperature of the third polyester resin be higher than the glass transition temperatures of the first polyester resin and the second polyester resin by 5° C. to 20° C. When the glass transition temperature of the third polyester resin is set to be higher than the glass transition temperatures of the first polyester resin and the second polyester resin, the heat resistance of the toner is improved.

In this exemplary embodiment, a proportion of a resin, which is insoluble in tetrahydrofuran (THF), in the toner particle is preferably 5% by weight or less, more preferably 3.0% by weight or less, and even more preferably 1.5% by weight or less. The resin fraction that is insoluble in the tetrahydrofuran is a component that is mainly derived from a polymer of the aromatic vinyl monomer and the unsaturated polyester resin.

When a THF-insoluble (gel) fraction is high, the heat resistance and the stress resistance of the toner are improved, but the low-temperature fixing property may be deteriorated. When the THF-insoluble (gel) fraction is set to be 5% by weight or less, a balance in the heat resistance, the stress resistance, and the low-temperature fixing property of the toner is promoted.

The proportion of the tetrahydrofuran (THF)-insoluble resin fraction in the toner particles may be 0% by weight, but the proportion may be 0.5% by weight or more from the viewpoint of securing the strength of the surface layer portion of the toner.

In this exemplary embodiment, a ratio (mass standard) of the aromatic vinyl monomer and the unsaturated polyester resin (third polyester resin) that make up the polymer, which is contained in the second shell layer, of the aromatic vinyl monomer and the unsaturated polyester resin is preferably 70:30 to 99.5:0.5, more preferably 80:20 to 95:5, and even more preferably 85:15 to 90:10.

When the ratio of the third polyester resin making up the polymer is low, the polymerization degree of the polymerization reaction is decreased, and thus the effect of improving the strength of the surface layer portion becomes low. On the other hand, when the ratio of the third polyester resin making up the polymer is high, viscosity of the aromatic vinyl monomer in which the third polyester resin is dissolved increases, and thus it may be difficult to form the second shell layer that is uniform on the surfaces of the toner particles. When the ratio (mass standard) of the aromatic vinyl monomer and the unsaturated polyester resin is within a range of from 70:30 to 99.5:0.5, the occurrence of the above-described problem is suppressed.

In this exemplary embodiment, it is preferable that a weight ratio of the second shell layer is from 0.1% by weight to 15% by weight of the toner particles. When the second shell layer is 0.1% by weight or more of the toner particles, there is an advantage in that the strength of the toner surface layer portion is improved. On the other hand, when the second shell layer is 15% by weight or less of the toner particles, there is an advantage in that a fixed image in which the low-temperature fixing property and the glossiness are high may be obtained. The second shell layer is more preferably from 0.5% by weight to 10.0% by weight of the toner particles, and even more preferably from 2.0% by weight to 7.0% by weight.

Properties of Toner

In this exemplary embodiment, the volume-average particle size of the toner is preferably in the range of from 4 μm to 9 μm, more preferably in the range of from 4.5 μm to 8.5 μm, and even more preferably in the range of from 5 μm to 8 μm. When the volume-average particle size is 4 μm or more, the toner flowability is improved, and the charging property of each particle is improved easily. In addition, since charging distribution is not widened, it is difficult for fogging of the background, the spill of the toner from the developing unit, or the like to occur. When the volume-average particle size is 4 μm or more, the cleaning property is not problematic. When the volume-average particle size is 9 μm or less, the resolution is improved, and thus a sufficient image quality may be obtained, and it is possible to satisfy the recent demand for a high quality image.

In addition, the volume-average particle size may be measured by a COULTER MULTISIZER (manufactured by Beckman Coulter, Inc.) with an aperture diameter of 50 μm. In this case, the toner is dispersed in an electrolyte aqueous solution (ISOTONE aqueous solution) and dispersed for 30 seconds or more by ultrasonic waves before the measurement.

In addition, the toner of this exemplary embodiment preferably has a spherical shape having a shape factor SF1 in the range of from 110 to 140. When the toner particles have a spherical shape in this range, the transfer efficiency and image denseness are improved, and an image having a high image quality is formed.

The shape factor SF1 is more preferably in the range of from 110 to 130.

The shape factor SF1 is determined by the following formula (1).

$$SF1=(ML^2/A)\times(\pi/4)\times 100 \qquad \text{formula (1)}$$

In the formula (I), ML represents the absolute maximum length of the toner, and A represents the projected area of the toner.

The above-described SF1 is converted into a numerical value mainly by analyzing a microscope image or a scanning electron microscope (SEM) image with an image analyzer, and is calculated, for example, as described below. That is, an optical microscope image of particles sprayed onto a surface of a slide glass is taken in a Luzex image analyzer via a video camera, the maximum length and the projected area of 100 particles are measured, calculation is carried out by the formula (1), and the average is calculated to obtain the SF1.

The toner of this exemplary embodiment may be prepared by adding the external additive to the toner particles after manufacturing the toner particles.

The method of manufacturing the toner particles is not particularly limited and may include, for example, an aggregated particle forming process of mixing a first polyester resin particle dispersion liquid in which a first polyester resin is dispersed, a colorant dispersion liquid in which a colorant is dispersed, and a release agent dispersion liquid in which a release agent is dispersed to form aggregated particles containing first polyester resin particles, colorant particles, and release agent particles, a first adhesion process of mixing a second polyester resin particle dispersion liquid in which a second polyester resin is dispersed and an aggregated particle dispersion liquid containing the aggregated particles to allow the second polyester resin particles to be adhered to surfaces of the aggregated particles so as to form resin-adhered aggregated particles, a process of coalescing the resin-adhered aggregated particles by heating them to form coalesced particles, a second adhesion process of mixing a polymerizable component containing an aromatic vinyl monomer and a third polyester resin having an ethylenic unsaturated double bond that is polymerizable with the aromatic vinyl monomer, and a coalesced particle dispersion liquid containing the coalesced particles to allow the polymerizable component to be adhered to surfaces of the coalesced particles so as to form adhered coalesced particles, and a process of polymerizing the aromatic vinyl monomer and the third polyester resin contained in the polymerizable component to form a polymer of the polymerizable component on the surfaces of the coalesced particles.

Emulsification Process

In addition to a method of preparing the resin particle dispersion liquid according to a general polymerization method, for example, an emulsification polymerization method, a suspension polymerization method, a dispersion polymerization method, and the like, the preparation of the resin particle dispersion liquid may be carried out by applying a shear force to a solution in which an aqueous medium and a binder resin are mixed using a disperser so as to emulsify the solution. At this time, particles may be formed by heating the solution to lower the viscosity of the resin component. In addition, a dispersing agent may be used for stability of the dispersed resin particles. Furthermore, when the resin is oily and may be dissolved in a solvent having relatively low water solubility, the resin is dissolved in the solvent, and then the particles of the resin are dispersed in water together with a dispersant and a polymer electrolyte, and then the resultant dispersed solution is heated or depressurized to remove the solvent by evaporation, whereby the resin particle dispersion liquid may be prepared.

In a case where the resin particle dispersion liquid is prepared using the polyester resin, a phase inversion emulsification method is used. In addition, even when the resin particle dispersion liquid is prepared using the binder resin other than the polyester resin, the phase inversion emulsification method may be used. In addition, the phase inversion emulsification method includes dissolving a resin to be dispersed in a hydrophobic organic solvent capable of dissolving the resin, neutralizing an organic continuous phase (O phase) by adding a base, and performing a resin conversion (so-called phase inversion) from W/O to O/W by adding an aqueous medium (W phase) to form a discontinuous phase, thereby dispersing the resin as particles in the aqueous medium.

Examples of the organic solvent used in the phase inversion emulsification include alcohols such as ethanol, n-propanol, isopropanol, n-butanol, isobutanol, sec-butanol, tert-butanol, n-amyl alcohol, isoamyl alcohol, sec-amyl alcohol, tert-amyl alcohol, 1-ethyl-1-propanol, 2-methyl-1-butanol, n-hexanol, and cyclohexanol; ketones such as methyl ethyl ketone, methyl isobutyl ketone, ethyl butyl ketone, cyclohexanone, and isophorone; ethers such as tetrahydrofuran, dimethyl ether, diethyl ether, and dioxane; esters such as methyl acetate, ethyl acetate, n-propyl acetate, isopropyl acetate, n-butyl acetate, isobutyl acetate, sec-butyl acetate, 3-methoxybutyl acetate, methyl propionate, ethyl propionate, butyl propionate, dimethyl oxalate, diethyl oxalate, dimethyl succinate, diethyl succinate, diethyl carbonate, and dimethyl carbonate; glycol derivatives such as ethylene glycol, ethylene glycol monomethyl ether, ethylene glycol monoethyl ether, ethylene glycol monopropyl ether, ethylene glycol monobutyl ether, ethylene glycol ethyl ether acetate, diethylene glycol, diethylene glycol monomethyl ether, diethylene glycol monoethyl ether, diethylene glycol monopropyl ether, diethylene glycol monobutyl ether, diethylene glycol ethyl ether acetate, propylene glycol, propylene glycol monomethyl ether, propylene glycol monopropyl ether, propylene glycol monobutyl ether, propylene glycol methyl ether acetate, and dipropylene glycol monobutyl ether; 3-methoxy-3-methylbutanol; 3-methoxybutanol; acetonitrile; dimethylformamide; dimethylacetamide; diacetone alcohol; ethyl acetoacetate; and the like. One kind of these solvents may be used alone, or two or more kinds thereof may be used in combination.

With respect to a solvent amount of the organic solvent used for the phase inversion emulsification, since the solvent amount for obtaining a desired dispersed particle size varies depending on physical properties of the resin, it is difficult to determine the solvent amount unconditionally. However, in this exemplary embodiment, in a case where the content of a tin compound catalyst in the resin is larger than that in a general polyester resin, the solvent amount based on the weight of the resin may be relatively large.

In a case where the binder resin is dispersed in water, as necessary, part or all of the carboxyl groups in the resin may be neutralized with a neutralizer. Examples of the neutralizer include inorganic alkalis such as potassium hydroxide, and sodium hydroxide; amines such as ammonia, monomethylamine, dimethylamine, triethylamine, monoethylamine, diethylamine, mono-n-propylamine, dimethyl-n-propylamine, monoethanolamine, diethanolamine, triethanolamine, N-methylethanolamine, N-aminoethylethanolamine, N-methyldiethanolamine, monoisopropanolamine, diisopropanolamine, triisopropanolamine, and N,N-dimethylpropanolamine. One kind selected from these neutralizers may be used alone, or two or more kinds thereof may be used in combination. The pH during emulsification is controlled to be neutral by adding such a neutralizer, thereby preventing hydrolysis of the resultant polyester resin dispersion liquid.

In addition, a dispersant may be added for the purpose of the dispersion of the dispersed particles and of preventing thickening of the aqueous medium during the phase inversion emulsification. Examples of the dispersant include water-soluble polymers such as polyvinyl alcohol, methyl cellulose, ethyl cellulose, hydroxyethyl cellulose, carboxymethyl cellulose, sodium polyacrylate, and sodium polymethacrylate; anionic surfactants such as sodium dodecylbenzenesulfonate, sodium octadecylsulfate, sodium oleate, sodium laurate, and potassium stearate; cationic surfactants such as laurylamine acetate, stearylamine acetate, and lauryltrimethylammonium chloride; amphionic surfactants such as lauryldimethylamine oxide; nonionic surfactants such as polyoxyethylene alkyl ethers, polyoxyethylene alkyl phenyl ethers, and polyoxyethylene alkyl amines; and inorganic compounds such as tricalcium phosphate, aluminum hydroxide, calcium sulfate, calcium carbonate, and barium carbonate; and the like. One kind of these dispersants may be used alone, or two or more kinds thereof may be used in combination. The dispersant is added in an amount of from 0.01 part by weight to 20 parts by weight based on 100 parts by weight of the binder resin.

In the phase inversion emulsification, the emulsification temperature may be equal to or lower than the boiling point of the organic solvent and may be equal or higher than the melting temperature or glass transition temperature of the binder resin. When the emulsification temperature is lower than the melting temperature or glass transition temperature of the binder resin, it is difficult to preparate the resin particle dispersed solution. When the emulsification is performed at the boiling point of the organic solvent or higher, the emulsification may be performed in a pressurized and closed apparatus.

Generally, the content of the resin particles in the resin particle dispersion liquid is preferably from 5% by weight to 50% by weight, and more preferably from 10% by weight to 40% by weight. When the content is outside this range, a particle size distribution of the resin particles becomes wide, and thus characteristics may be deteriorated.

Resin Particle Dispersion Liquid

The volume-average particle size of the resin particles dispersed in the resin particle dispersion liquid is preferably from 0.01 μm to 1 μm, more preferably from 0.03 μm to 0.8 μm, and even more preferably from 0.03 μm to 0.6 μm.

The volume-average particle size of the particles such as the resin particles that are contained in the raw material dispersion liquid is measured using a laser diffraction particle size distribution analyzer (LA-700, manufactured by Horiba, Ltd.).

Examples of the aqueous medium include water such as distilled water and ion-exchanged water; and alcohols, but an aqueous medium composed of only water is preferable.

In addition, examples of the dispersant used in the emulsification process include water-soluble polymers such as polyvinyl alcohol, methyl cellulose, ethyl cellulose, hydroxyethyl cellulose, carboxymethyl cellulose, sodium polyacrylate, and sodium polymethacrylate; anionic surfactants such as sodium dodecylbenzenesulfonate, sodium octadecylsulfate, sodium oleate, sodium laurate, and potassium stearate; cationic surfactants such as laurylamine acetate, stearylamine acetate, and lauryltrimethylammonium chloride; amphionic surfactants such as lauryldimethylamine oxide; nonionic surfactants such as polyoxyethylene alkyl ethers, polyoxyethylene alkyl phenyl ethers, and polyoxyethylene alkylamines; and inorganic salts such as tricalcium phosphate, aluminum hydroxide, calcium sulfate, calcium carbonate, and barium carbonate; and the like.

Examples of a disperser used for preparing emulsified liquid include a homogenizer, a homomixer, a pressurization kneader, an extruder, and a media disperser.

When preparing the release agent dispersion liquid, the release agent is dispersed in water together with an ionic surfactant and a polymer electrolyte such as a high-molecular-weight acid, and a high-molecular-weight base, and then the resultant dispersion liquid is subjected to a dispersing treatment using the homogenizer or the pressure-ejecting disperser that is capable of applying a strong shearing force while heating the resultant dispersed material at a temperature that is equal to or higher than the melting temperature of the release agent. By performing this treatment, the release agent dispersion liquid may be obtained. During the dispersing treatment, an inorganic compound such as polyaluminum chloride may be added to the dispersion liquid. Examples of a preferable inorganic compound include polyaluminum chloride, aluminum sulfate, highly basic polyaluminum chloride (BAC), polyaluminum hydroxide, aluminum chloride, and the like. Among these, polyaluminum chloride, aluminum sulfate, and the like are preferable. The release agent dispersion liquid is used for the emulsification aggregation method, but the release agent dispersion liquid may be used when the toner is manufactured by a suspension polymerization method.

By dispersion treatment, a release agent dispersion liquid containing release agent particles having a volume-average particle size of 1 μm or less may be obtained. The volume-average particle size of the release agent particles is more preferably from 100 nm to 500 nm.

When the volume-average particle size is 100 nm or more, the release agent component, although being influenced by the characteristics of the binder resin used, is easily incorporated into the toner. When the volume-average particle size is 500 nm or less, the dispersed state of the release agent in the toner becomes sufficient.

The preparation of the colorant dispersion liquid may be performed using known dispersing method, and for example, a general dispersing unit such as a rotary shearing homogenizer, a ball mill including a medium, a sand mill, a dynomill, and an ultimizer may be used without any limitation. The colorant is dispersed in water together with an ionic surfactant and a polymer electrolyte such as a high-molecular-weight acid, and a high-molecular-weight base. A volume-average particle size of the dispersed colorant particle is preferably 1 μM or less, but in a range of from 80 nm to 500 nm, aggregability is not deteriorated and dispersion of the colorant in the toner is preferable, such that this range is also preferable.

Aggregated Particle Forming Process

In a process of forming the aggregated particles, a first polyester resin particle dispersion liquid, the colorant dispersion liquid, the release agent dispersion liquid, and the like are mixed to form a mixed liquid, and this resultant mixed liquid is heated at a temperature that is equal to or lower than the glass transition temperature of the first polyester resin particles to cause aggregation, whereby forming aggregated particles containing first polyester resin particles, colorant particles, and release agent particles. The formation of the aggregated particles is frequently performed by setting a pH of the mixed liquid to an acidic environment while stirring the mixed liquid. Here, a pH of from 2 to 7 is preferable, and an aggregating agent may be effectively used in this case.

In addition, in the process of forming the aggregated particles, the release agent dispersion liquid may be added and mixed at a time together with various kinds of dispersion liquid such as the resin particle dispersion liquid, or may be added plural times in a divided manner.

As the aggregating agent, a surfactant having a polarity opposite to the polarity of the surfactant used as the dispersant, an inorganic metal salt, and a divalent or higher metal complex are preferably used. Particularly, a metal complex is more preferably used because an amount of the surfactant used may be reduced and thus the charging property is improved.

As the inorganic metal salt, particularly, an aluminum salt and a polymer thereof are suitable. To obtain a relatively narrow particle size distribution, with regard to the valence of the inorganic metal salt, divalent is better than monovalent, trivalent is better than divalent, and tetravalent is better than trivalent, and among those having the same valence, an inorganic metal salt polymer of polymerization type is more suitable.

In this exemplary embodiment, a polymer of tetravalent inorganic metal salt containing aluminum is preferably used to obtain a narrow particle size distribution.

First Adhesion Process

In a first adhesion process, second polyester resin particles are adhered on surfaces of the aggregated particles that are formed after undergoing the above-described aggregated particle forming process to form a coated layer (the aggregated particles having the coated layer on a surface thereof may be referred to as "resin-adhered aggregated particles"). Here, the coated layer corresponds to a first shell layer that is formed through a coalescence process to be described later.

A volume-average particle size of the second polyester resin particles is preferably from 0.05 μm to 1 μm, and more preferably from 0.08 μm to 0.5 μm.

The formation of the coated layer may be performed by mixing the aggregated particle dispersion liquid containing the aggregated particles that is obtained in the aggregated particle forming process, and a second polyester resin particle dispersion liquid in which the second polyester resin is dispersed. Other components such as the aggregating agent may be additionally added as necessary.

When the second polyester resin particles are adhered on the surfaces of the aggregated particles to form the coated layer, and the resin-adhered aggregated particles are heated and coalesced in a coalescence process to be described later, the second polyester resin particles contained in the coated layer on the surfaces of the aggregated particles are melted to form the first shell layer. Therefore, the release agent and the colorant that are contained in the core portion that is located at an inner side of the first shell layer may be effectively prevented from being exposed to the surface of the toner.

A method of adding and mixing the second polyester resin particle dispersion liquid in the first adhesion process is not particularly limited. For example, this method may be performed gradually and continuously, or may be performed step by step over plural times in a divided manner. In this manner, when the second polyester resin particle dispersion liquid is added and mixed, the generation of minute particles may be suppressed, whereby the obtained particle size distribution of the toner may be sharp.

In this exemplary embodiment, the first adhesion process may be conducted once or plural times. By changing a resin, a shell of plural layers may be prepared.

A condition of adhering the second polyester resin particles to the aggregated particles is as follows. That is, it is preferable that the heating temperature in the first adhesion process be within a temperature range from the glass transition temperature of the first polyester resin contained in the aggregated particles to the glass transition temperature of the binder resin (second polyester resin) for the shell layer.

The heating time in the first adhesion process depends on the heating temperature and cannot be specified definitely, but is usually from 5 minutes to 2 hours.

In addition, in the first adhesion process, dispersion liquid, which is obtained by additionally adding the second polyester resin particle dispersion liquid to the dispersion liquid in which the aggregated particles are formed, may be left still or may be mildly stirred using a mixer or the like. The latter is advantageous because uniform resin-adhered aggregated particles may be formed easily.

In addition, in the first adhesion process, an amount of the second polyester resin particle dispersion liquid used depends on a particle size of the resin particles contained therein, but the amount used is preferably selected in such a manner that the thickness of the first shell layer that is ultimately formed becomes from 20 nm to 500 nm.

Coalescence Process

In the coalescence process, the progress of aggregation is stopped by raising a pH of a suspension liquid of the resin-adhered aggregated particles to a range of from 3 to 9 under a stirring condition according to the aggregated particle forming process, and then the suspension liquid is heated at a temperature that is equal to or higher than the glass transition temperature of the resin and the resin-adhered aggregated particles are coalesced, whereby coalesced particles are obtained. The heating may be performed for a time to realize the coalescence, and the heating may be preferably performed for 30 minutes to 10 hours.

Second Adhesion Process

Ina second adhesion process, a polymerizable component, which contains the aromatic vinyl monomer and the third polyester resin having an ethylenic unsaturated double bond that is polymerizable with the aromatic vinyl monomer, is adhered on surfaces of the coalesced particles that are formed through the above-described coalescence process, and an adhered layer is formed (the coalesced particles provided with the adhered layer on a surface thereof may be referred to as "adhered coalesced particles"). Here, this adhered layer corresponds to the second shell layer that is formed through a polymerization process to be described later.

The formation of this adhered layer may be performed by mixing the coalesced particle dispersion liquid containing the coalesced particles that are formed through the coalescence process and the polymerizable component. The polymerizable component that is used in the formation of the adhered layer may be a polymerizable component dispersion liquid.

A solvent, a polymerization initiator, or the like may be added to the polymerizable component as necessary.

Examples of the solvent that may be added to the polymerizable component include an alcoholic organic solvent, an aliphatic organic solvent, an aromatic organic solvent, and the like. In a case where the solvent is added to the polymerizable component, the proportion of the solvent in the polymerizable component is preferably from 5.0% by weight to 10.0% by weight. In a case where the uniform adhesion of the polymerizable component to the surfaces of the coalesced particles is hindered due to high viscosity of the polymerizable component, a polymerizable component having preferable viscosity may be prepared by adding the solvent to the polymerizable component.

Examples of the polymerization initiator that is used in this exemplary embodiment include, but are not limited to, peroxides such as hydrogen peroxide, acetyl peroxide, cumyl peroxide, tert-butyl peroxide, propionyl peroxide, benzoyl peroxide, chlorobenzoyl peroxide, dichlorobenzoyl peroxide, bromomethyl benzoyl peroxide, lauroyl peroxide, ammonium persulfate, sodium persulfate, potassium persulfate, diisopropyl peroxy carbonate, tetralin hydroperoxide, 1-phenyl-2-methylpropyl-1-hydroperoxide, pertriphenyl acetate-tert-butyl hydroperoxide, tert-butyl performate, tert-butyl peracetate, tert-butyl perbenzoate, tert-butyl perphenylacetate, tert-butyl permethoxyacetate, tert-butyl perN-(3-toluoyl)carbamate, ammonium bisulfate, and sodium bisulfate.

In addition, as an oil-soluble polymerization initiator, for example, an azo-based polymerization initiator such as 2,2'-azobisisobutyronitrile, 2,2'-azobis (2,4-dimethylvaleronitrile), 1,1'-azobis(cyclohexane-1-carbonitrile), and 2,2'-azobis-4-methoxy-2,4-dimethylvaleronitrile may be exemplified.

The polymerizable component dispersion liquid may be prepared by applying a shearing force to a solution obtained by mixing the polymerizable component and the aqueous medium using a disperser. As the aqueous medium and the disperser, those described in the emulsification process may be used.

A method of adding and mixing the polymerizable component in the second adhesion process is not particularly limited. For example, this method may be performed gradually and continuously, or may be performed step by step over plural times in a divided manner.

A condition of adhering the polymerizable component to the coalesced particles is as follows.

The coalesced particle dispersion liquid is heated while being stirred and dispersed, the polymerization initiator is added, and then the polymerizable component dispersion liquid may be added.

Polymerization Process

In the polymerization process, the aromatic vinyl monomer and the third polyester resin that are contained in the polymerizable component are polymerized and thereby a polymer of the polymerizable component is formed on surfaces of the coalesced particles.

The formation of this polymer may be performed, for example, under a condition in which a reaction temperature is from 50° C. to 100° C. (preferably 60 to 90° C.), and a reaction time is from 30 minutes to 5 hours (preferably from 1 hour to 4 hours).

In the polymerization process, a polymerizable component to which a polymerization initiator is added may be used, the polymerizable component and the coalesced particle dispersion liquid may be mixed in a state in which the polymerization initiator is added to the coalesced particle dispersion liquid in advance, the polymerization initiator may be added after the polymerizable component and the coalesced particle dispersion liquid are mixed, or the polymerization initiator may be added to the reaction system with a method other than these methods.

After the polymerization process, toner particles are obtained after being subjected to a solid and liquid separating process such as a filtering process, and a cleaning process and a drying process as necessary.

For the purpose of charging adjustment, conferring flowability, conferring charge exchange property, and the like, inorganic oxides or the like that are represented by silica, titania, and aluminum oxide may be added and adhered to the resulting toner particles as an external additive. This mixing may be performed with a known mixing machine such as a V-type blender, a Henschel mixer, and a Loedige mixer to adhere the inorganic oxides thereto in separate stages. An added amount of the external additive is preferably a range of from 0.1 part by weight to 5 parts by weight based on 100 parts by weight of the toner particles, and more preferably a range of from 0.3 part by weight to 2 parts by weight.

Furthermore, an ultrasonic sieve machine, a vibration sieve machine, a wind classifier, or the like may be used to remove coarse particles of the toner after the external addition as necessary.

In addition to the external additive, other components (particles) such as a charge-controlling agent, organic particles, a lubricant, and an abrasive may be added.

Although not being particularly limited, as the charge-controlling agent, a colorless or light-colored charge-controlling agent may be preferably used. Examples of such charge-controlling agents include quaternary ammonium salt compounds, nigrosine-based compounds, complexes of aluminum, iron, chromium, or the like, triphenylmethane-based pigments, or the like.

The organic particles include particles such as vinyl-based resin, polyester resin, and silicone resin that are normally used as an external additive for toner surfaces. These inorganic or organic particles may be used as a flowability assisting agent, a cleaning assisting agent, or the like.

The lubricant includes aliphatic amides such as ethylene bisstearic acid amide and oleic acid amide, aliphatic metal salts such as zinc stearate and calcium stearate, or the like.

The abrasive includes the above-mentioned silica, alumina, cerium oxide, or the like.

Electrostatic Charge Image Developer

The developer in this exemplary embodiment may be a single-component developer including the toner of this exemplary embodiment or may be a two-component developer containing a carrier and the toner of this exemplary embodiment. When the toner is used in the two-component developer, the toner is mixed with a carrier to form a two-component developer. Hereinafter, a description will be made with respect to a case of the two-component developer.

The carrier that may be used in the two-component developer is not particularly limited, and any known carriers may be used. Examples thereof include magnetic metals such as iron oxide, nickel, and cobalt; magnetic oxides such as ferrite and magnetite; resin-coated carriers having a resin-coated layer on a surface of a core; magnetic dispersion type carriers; and the like. The carrier may also be a resin dispersion type carrier in which an electrically conductive material or the like is dispersed in a matrix resin.

Examples of the coating resin or matrix resin used in the carrier include, but are not limited to, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin having organosiloxane bonds, and a modified product thereof, fluororesin, polyester, polycarbonate, phenolic resin, epoxy resin, (meth)acryl-based resin, dialkylaminoalkyl (meth)acryl-based resin, and the like. Among these, dialkylaminoalkyl (meth)acryl-based resin is preferable from the viewpoints of a large quantity of charging or the like.

Examples of the electrically conductive material include, but are not limited to, metals such as gold, silver, and copper, carbon black, titanium oxide, zinc oxide, barium sulfate, aluminum borate, potassium titanate, tin oxide, and the like.

Examples of the core of the carrier include magnetic metals such as iron, nickel, and cobalt; magnetic oxides such as ferrite and magnetite; glass beads; and the like. The core is preferably a magnetic substance so as to use the carrier in a magnetic brush method. The volume-average particle size of the core of the carrier is generally in the range of from 10 μm to 500 μm, preferably in the range of from 30 μm to 100 μm.

A method of coating the surface of the core of the carrier with a resin may be a method in which the surface is coated with a coating layer forming solution obtained by dissolving the above-described coating resin and various kinds of additives as necessary in an appropriate solvent. The solvent is not particularly limited, and may be selected appropriately in consideration of the coating resin to be used, suitability for application, and the like.

Specific examples of the resin coating method include a dipping method in which the core of the carrier is dipped in the coating layer forming solution; a spray method in which the coating layer forming solution is sprayed onto the surface of the core of the carrier; a fluidized bed method in which the coating layer forming solution is sprayed onto the core of the carrier that is being floated by fluidizing air; and a kneader coater method in which the core of the carrier is mixed with the coating layer forming solution in a kneader coater and the solvent is removed; and the like.

The mixing ratio (ratio by weight) of the toner in this exemplary embodiment to the carrier in the two-component developer is preferably in a range of from 1:100 to 30:100 (toner:carrier), more preferably in a range of from 3:100 to 20:100.

Image Forming Apparatus

Next, a description will be made with respect to an image forming apparatus of this exemplary embodiment, which uses the toner of this exemplary embodiment.

The image forming apparatus of this exemplary embodiment includes a photoreceptor, a charging unit that charges the photoreceptor, an electrostatic charge image forming unit that forms an electrostatic charge image on the surface of the photoreceptor that is charged, a developing unit that develops the electrostatic charge image formed on the surface of the photoreceptor as a toner image by using the developer of this exemplary embodiment, a transfer unit that transfers the toner image onto a transfer medium, and a fixing unit that fixes the toner image that is transferred onto the transfer medium.

In addition, in this image forming apparatus, for example, a portion including the developing unit may have a cartridge structure (process cartridge) that is detachable from a main body of the image forming apparatus. As the process cartridge, the process cartridge of this exemplary embodiment, which includes at least a developer holding body and accommodates the developer of this exemplary embodiment therein, may be appropriately used.

Hereinafter, an example of the image forming apparatus of this exemplary embodiment will be described, but it is not limited thereto. In addition, main portions shown in drawings will be described and a description with respect to other portions will be omitted.

FIG. 1 shows a schematic configuration diagram illustrating a four-drum tandem-type color image forming apparatus. The image forming apparatus shown in FIG. 1 is provided with first to fourth electro-photographic type image forming units 10Y, 10M, 10C, and 10K that output image of respective colors of yellow (Y), magenta (M), cyan (C), and black (K) based on color-separated image data, respectively. These image forming units (hereinafter, may be referred to simply as "units") 10Y, 10M, 100, and 10K are arranged in parallel in the horizontal direction with a predetermined space therebetween. The units 10Y, 10M, 100, and 10K may be process cartridges that are detachable from the main body of the image forming apparatus.

Above the respective units 10Y, 10M, 100, and 10K in the drawing, an intermediate transfer belt 20 is provided to extend as an intermediate transfer member through the respective units. The intermediate transfer belt 20 is provided by being wound around a driving roller 22 and a supporting roller 24 that contacts the inner surface of the intermediate transfer belt 20, the rollers 22 and 24 being arranged to be apart from each other from the left to right in the drawing, and the intermediate transfer belt 20 runs in the direction of from the first unit 10Y to the fourth unit 10K. The supporting roller 24 is biased with a spring or the like (not shown) so as to be apart from the driving roller 22, and tension is applied to the intermediate transfer belt 20 wound between the two rollers. An intermediate transfer member cleaning unit 30 is provided on the side of image-holding surface of the intermediate transfer belt 20 in a manner to be opposite to the driving roller 22.

In addition, toners of four colors of yellow, magenta, cyan, and black that are accommodated in toner cartridges 8Y, 8M, 8C and 8K may be supplied to developing units 4Y, 4M, 4C and 4K for the respective units 10Y, 10M, 100 and 10K, respectively.

The first to fourth units 10Y, 10M, 100 and 10K have a configuration similar to one another, so that only the first unit 10Y, which forms a yellow image and is arranged on the upstream side in the traveling direction of the intermediate transfer belt, will be described here as a representative one. A description of the second to fourth units 10M, 100 and 10K will be omitted by assigning reference numerals of magenta (M), cyan (C) and black (K) to the equivalent part of the first unit 10Y in place of yellow (Y).

The first unit 10Y has a photoreceptor 1Y acting as an image holding member. A charging roller 2Y, an exposure unit (electrostatic charge image forming unit) 3, a developing unit 4Y, a primary transfer roller (primary transfer unit) 5Y, and a photoreceptor cleaning unit (cleaning unit) 6Y are sequentially provided around the photoreceptor 1Y. The charging roller 2Y charges the surface of the photoreceptor 1Y at a predetermined potential. The exposure unit 3 exposes the charged surface to laser beams 3Y based on color-separated image signals to form an electrostatic charge image. The developing unit 4Y develops the electrostatic charge image by feeding an charged toner to the electrostatic charge image. The primary transfer roller 5Y transfers the resultant developed toner image onto the intermediate transfer belt 20. The photoreceptor cleaning unit 6Y removes a toner remaining on the surface of the photoreceptor 1Y after the primary transfer.

In addition, the primary transfer roller 5Y is arranged at an inner side of the intermediate transfer belt 20 and is provided at a position opposite to the photoreceptor 1Y. A bias power source (not shown) that applies primary transfer bias is connected to each of the primary transfer rollers 5Y, 5M, 5C and 5K. Each bias power source may change the transfer bias applied to each primary transfer roller through control by a controller (not shown).

Hereinafter, an operation of forming a yellow image in the first unit 10Y will be described. First, the surface of the photoreceptor 1Y is charged at a potential of −600 to −800 V with a charging roller 2Y prior to operation.

The photoreceptor 1Y is formed by laminating a photosensitive layer on an electroconductive base (volume resistivity at 20° C. is $1\times10^{-6}$ Ωcm or less). This photosensitive layer is usually highly resistant (with substantially the same resistance as that of general resin), but upon irradiation with laser beams 3Y, the specific resistance of the portion irradiated with the laser beams varies. According to image data for yellow transmitted from the controller (not shown), the laser beams 3Y are output from the exposure unit 3 onto the surface of the charged photoreceptor 1Y. The photosensitive layer as the surface portion of the photoreceptor 1Y is irradiated with the laser beams 3Y, whereby an electrostatic charge image in a yellow print pattern is formed on the surface of the photoreceptor 1Y.

An electrostatic charge image is an image formed on the surface of the photoreceptor 1Y by charging. That is, this image is a so-called negative latent image that is obtained by causing the electrified charge on the surface of the photoreceptor 1Y to flow due to a reduction in the specific resistance on the irradiated portion of the photosensitive layer by the laser beams 3Y, while charge remains on the portion not irradiated with laser beams 3Y.

The electrostatic charge image formed on the photoreceptor 1Y in this manner is rotated to a predetermined development position with running of the photoreceptor 1Y. In this development position, the electrostatic charge image on the photoreceptor 1Y is made into a visual image (a developed image) with the developing unit 4Y.

For example, an electrostatic charge image developer containing at least the yellow toner and a carrier is accommodated in the developing unit 4Y. The yellow toner is stirred at the inside of the developing unit 4Y and thereby is frictionally electrified. The yellow toner has a charge having the same polarity (negative polarity) as that of electrified charge on the photoreceptor 1Y, and is retained on a developer roll (developer-holding member). The surface of the photoreceptor 1Y passes through the developing unit 4Y, thereby allowing the yellow toner to adhere electrostatically to the electrically neutralized latent image portion on the surface of the photoreceptor 1Y, and thus developing the latent image with the yellow toner.

From the viewpoints of development efficiency, image graininess, grayscale reproducibility, and the like, a bias potential (development bias) in which an alternating current component overlaps a direct current component may be applied to the developer holding member. Specifically, when a DC application voltage Vdc of the developer holding member is set to from −300 V to −700 V, the AC voltage peak width Vp-p of the developer holding member may be set to a range of from 0.5 kV to 2.0 kV.

The photoreceptor 1Y on which the yellow toner image is formed runs continuously at a predetermined speed, and the toner image developed on the photoreceptor 1Y is transmitted to a primary transfer position that is determined in advance.

When the yellow toner image on the photoreceptor 1Y is delivered to the primary transfer position, a primary transfer bias is applied to the primary transfer roller 5Y, and electrostatic force from the photoreceptor 1Y to the primary transfer roller 5Y acts on the toner image, and the toner image on the photoreceptor 1Y is transferred onto the intermediate transfer belt 20. The transfer bias that is applied at this time has (+) polarity reverse to the polarity (−) of the toner, and for example, the transfer bias in the first unit 10Y is adjusted at substantially +10 μA by the controller (not shown).

On the other hand, the toner remaining on the photoreceptor 1Y is removed and recovered by the cleaning device 6Y.

The primary transfer bias applied to primary transfer rollers 5M, 5C and 5K after second unit 10M is also controlled in the same manner as in the first unit.

The intermediate transfer belt 20 onto which the yellow toner image is transferred in the first unit 10Y is sequentially delivered through the second to fourth units 10M, 100, and 10K in this order, whereby toner images of respective colors overlap each other and are transferred.

The intermediate transfer belt 20 onto which toner images of four colors are transferred through the first to fourth units reaches a secondary transfer part made up by the intermediate transfer belt 20, the supporting roller 24 that comes into contact with the inner surface of the intermediate transfer belt 20, and a secondary transfer roller (secondary transfer unit) 26 arranged at the side of the image-holding surface of the intermediate transfer belt 20. On the other hand, a recording paper (transfer medium) P is put via a feeding mechanism with predetermined timing into a gap between the secondary transfer roller 26 and the intermediate transfer belt 20 that are contacted with each other with pressure, and a secondary transfer bias is applied to the support roller 24. The transfer bias that is applied at this time has the same (−) polarity as the polarity (−) of the toner, and electrostatic force from the intermediate transfer belt 20 to the recording paper P acts on the toner image, and the toner image on the intermediate transfer belt 20 is transferred onto the recording paper P. The secondary transfer bias is determined depending on resistance detected by a resistance detector (not shown) that detects the resistance of the secondary transfer part and is voltage-controlled.

Thereafter, the recording paper P is transmitted to a pressure contact part (a nip part) of a pair of fixing rolls in a fixing unit (a roll-shaped fixing unit) 28 and the toner images are heated, and the color overlapping toner images are melted and fixed on the recording paper P.

Examples of the transfer medium onto which a toner image is transferred include plain paper and an OHP sheet used in an electro-photographic type copier, printer, or the like.

The recording paper P after the color image is fixed is delivered toward a discharge portion, and a series of color-image forming operations is finished.

The image forming apparatus illustrated above is structured such that a toner image is transferred via the intermediate transfer belt 20 onto the recording paper P, but may, without limitation to this structure, be structured such that a toner image is transferred directly from the photoreceptor to the recording paper.

Process Cartridge and Toner Cartridge

Figure 2:
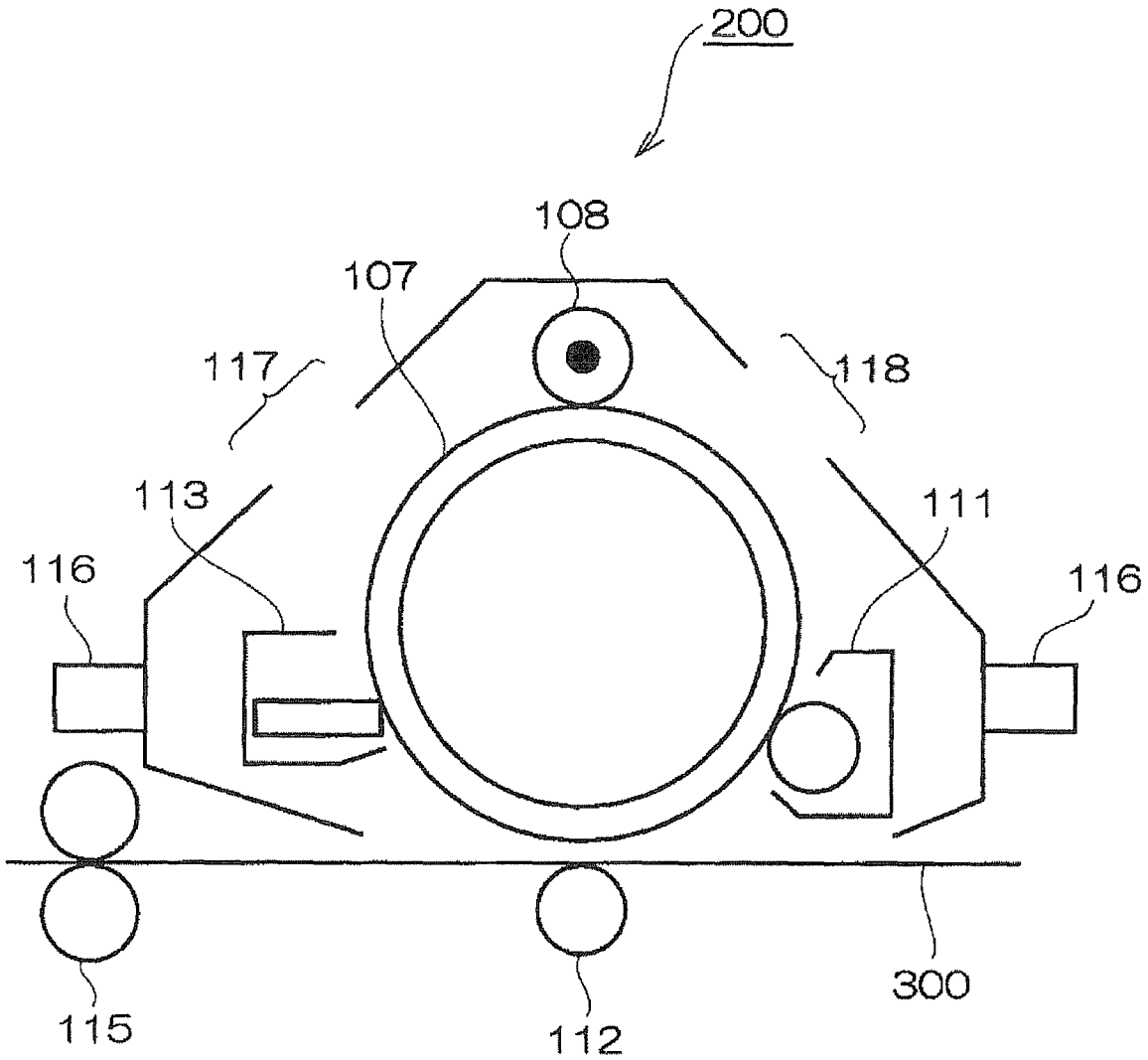
FIG. 2 is a schematic configuration diagram illustrating an example of a process cartridge of this exemplary embodiment.

FIG. 2 shows a schematic configuration diagram illustrating a preferable example of a process cartridge accommodating the developer of this exemplary embodiment. A process cartridge 200 includes a developing unit 111, a photoreceptor 107, a charging roller 108, a photoreceptor cleaning unit 113, an opening portion 118 for light exposure, and an opening portion 117 for erasing exposure that are combined using a mounting rail 116 and are integrated with each other. In addition, in FIG. 2, a reference numeral 300 represents a transfer medium.

In addition, this process cartridge 200 is detachable from a main body of the image forming apparatus that is made up by a transfer unit 112, a fixing unit 115 and other component parts (not shown), and makes up the image forming apparatus together with the main body of the image forming apparatus.

The process cartridge 200 shown in FIG. 2 is provided with the photoreceptor 107, the charging unit 108, the developing unit 111, the cleaning unit 113, the opening portion 118 for light exposure, and the opening portion 117 for erasing exposure, but these units may be selectively combined. In addition to the developing unit 111, the process cartridge of this exemplary embodiment may be provided with at least one kind selected from a group consisting of the photoreceptor 107, the charging unit 108, the cleaning unit 113, the opening portion 118 for light exposure, and the opening portion 117 for erasing exposure.

Next, the toner cartridge of this exemplary embodiment will be described. The toner cartridge of this exemplary embodiment is a toner cartridge that is detachably mounted in the image forming apparatus and that accommodates at least a toner to be supplied to the developing unit provided in the image forming apparatus, in which the toner is the toner of the above-described exemplary embodiment. The toner cartridge of this exemplary embodiment may accommodate at least a toner, and for example, a developer may be accommodated therein depending on the mechanism of the image forming apparatus.

In the image forming apparatus configured in such a manner that the toner cartridge may be detachable therefrom, the toner of this exemplary embodiment may be easily supplied to the developing unit by using the toner cartridge accommodating the toner of this exemplary embodiment.

The image forming apparatus shown in FIG. 1 is an image forming apparatus configured in such a manner that the toner cartridges 8Y, 8M, 8C, and 8K are detachable from the apparatus. The developing units 4Y, 4M, 4C, and 4K are connected via toner feeding pipes (not shown) to the toner cartridges corresponding to the respective developing units (colors). When the toner accommodated in the toner cartridge is reduced, the toner cartridge may be exchanged with another.

The toner cartridge may be any known resins such as polystyrene, acrylic resin, polystyrene-acryl copolymer, ABS resin, polycarbonate resin, polypropylene resin, polyethylene resin, polyester resin, acrylonitrile resin, and PET resin. From the viewpoints of strength, workability, stability, or the like, polystyrene, acrylic resin, polystyrene-acryl copolymer, ABS resin, or polycarbonate resin is more preferable. In addition, a known structure material such as metallic material, paper, or a non-woven fabric may be used.

The toner cartridge may have an arbitrary shape such as a cylindrical shape, a columnar shape, a box shape, a bottle shape, a composite type of these shapes, or the like. This shape may be arbitrarily selected from the viewpoints of an internal layout of the image forming apparatus, an exchange and mounting property, a feeding property of a supply toner, or the like. From the viewpoints of the internal layout of the image forming apparatus, the exchange and mounting property, the feeding property of the supply toner, or the like, the disposition of the cartridge at the inside of the image forming apparatus may be arbitrarily selected from a vertical disposition, a horizontal disposition, and the like. For high integration of the layout accompanying the miniaturization of the image forming apparatus, the shape of the cartridge is preferably a cylindrical shape, a columnar shape, or a composite type of the cylindrical shape and the box shape, and the disposition of the cartridge at the inside of the image forming apparatus is preferably a horizontal disposition, but it is not limited thereto.

EXAMPLES

Hereinafter, the exemplary embodiment will be more specifically described with reference to examples and comparative examples, but this exemplary embodiment is not limited to the following examples.

First, in the examples, each measurement is performed as described below.

Each Measurement Method

Method of Measuring Particle Size and Particle Size Distribution

A description will be made with respect to measurement of a particle size, and a particle size distribution.

In a case where the particle size to be measured is 2 μm or more, as a measuring device, a COULTER MULTISIZER type II (manufactured by Beckman Coulter Inc.) is used, and as an electrolytic solution, ISOTONE II (manufactured by Beckman Coulter Inc.) is used.

The measuring method is as follows. 0.5 mg to 50 mg of a measurement sample is added to 2 ml of a 5% aqueous solution of sodium alkylbenezenesulfonate that is a surfactant as a dispersant. This resultant solution is added to 100 ml of an electrolytic solution.

The electrolytic solution containing the measurement sample suspended therein is subjected to dispersion treatment for 1 minute using an ultrasonic disperser. Then, a particle size distribution of particles of from 2 μm to 60 μm is measured with the COULTER MULTISIZER type II using a 100 μm aperture as an aperture diameter to determine a volume-average distribution and a number-average distribution. The number of particles to be measured is 50,000.

A cumulative distribution is drawn from the smaller diameter end in regard to the volume and the number thereof according to a particle size range (channel) divided based on the particle size distribution that is measured. The particle size at a cumulative percentage of 50% in volume is defined as a volume-average particle size D50v, and the particle size at a cumulative percentage of 50% in number is defined as a number-average particle size D50p. In addition, the volume-average particle size and the particle-size distribution of the toner are not significantly changed by the addition of the external additive.

In addition, in a case where the particle size to be measured is less than 2 μm, the measurement is performed using a laser diffraction particle size distribution analyzer (LA-700, manufactured by Horiba, Ltd.). The measurement method is as follows. A sample in the form of a dispersion solution is adjusted so as to be 2 g in terms of solid content, and ion-exchanged water is added thereto to prepare a solution of 40 ml. This solution is put into a cell until an appropriate concentration is achieved. Then, the measurement is performed after the solution in the cell is left for 2 minutes and the concentration of the solution in the cell is almost stabilized. The volume-average particle sizes that are obtained for each of the channels are accumulated from small volume-average particle sizes. The particle size at which a cumulative percentage of 50% is attained is defined as a volume-average particle size.

Method of Measuring Melting Temperature and Glass Transition Temperature

The melting temperature and the glass transition temperature are determined by a DSC (differential scanning calorimeter) measuring method, and are obtained from a primary maximum peak that is measured in accordance with ASTMD3418-8.

The primary maximum peak may be measured using a DSC-7 manufactured by Perkin-Elmer. For the temperature calibration of the detective portion of this unit, the melting temperatures of both indium and zinc are used, and for the calibration of calories, the melting heat of indium is used. The sample is measured by using an aluminum pan, and an empty pan is set for comparison. Measurement is performed at a rate of temperature increase of 10° C./min.

Method of Measuring Softening Temperature of Resin and Toner

A softening temperature is obtained using a Koka-type flow tester CFT-500 (manufactured by Shimadzu Corporation) under conditions in which a diameter of a fine hole of a dice is set to 0.5 mm, a pressure load is set to 0.98 MPa (10 $kgf/cm^2$), and a rate of temperature increase is set to 1° C./minute. The softening temperature is obtained as a temperature corresponding to the half of the height from a flow initiation point to a termination point when a sample of 1 $cm^3$ is melted and is made to flow.

Proportion of THF-Insoluble Resin Fraction

The THF-insoluble resin fraction is measured as follows.

(1) 200 mg to 300 mg of a sample is directly weighed using a conical flask of 25 ml and 20 ml of THF is added thereto, and then the resultant material is left overnight.

(2) The resultant material in the conical flask is put into a centrifugal tube made of Teflon (registered trademark).

(3) In the conical flask in (1), rinsing is performed one more time with 20 ml of THF, and then rinse solution in the conical flask is put into the tube of (2). Thus, at total amount of THF becomes 40 ml. The tube is sealed.

(4) Centrifugation is performed with respect to the sealed tube of (3) for 20 minutes under conditions in which the number of rotations is 18,000 rpm and a temperature is −10° C.

(5) The treated material of (4) is taken out and is left until it returns to room temperature.

(6) 5 ml of supernatant liquid of (5) is weighed and taken out into an aluminum plate of which the weight has been measured, and then THF of a solvent is evaporated on a hot plate.

(7) A remaining material of (6) is put into a vacuum dryer at 50° C. and is dried by being left overnight. This dried material is weighed together with the weight of the aluminum plate as a toluene-soluble component in 5 ml.

(8) A THF-insoluble fraction is calculated by the following expression: {<weight of the sample>−[(<weight of the THF-soluble component and the aluminum plate>−<weight of the aluminum plate>)×40/5]}÷<weight of the sample>×100=THF-insoluble fraction (%)

Synthesis of Amorphous Polyester Resin A

Polyester Resin not Having Ethylenic Unsaturated Double Bond 60 parts by mole of bisphenol A propylene oxide 2-mole adduct, 40 parts by mole of bisphenol A ethylene oxide 2-mole adduct, 50 parts by mole of terephthalic acid, 40 parts by mole of dodecenylsuccinic acid, and 0.1 part by mole of dibutyltin oxide are put into a heated and dried three-necked flask, and the internal pressure of the flask is decreased through a reduced pressure operation, and then the inside of the flask is set to an inert atmosphere with nitrogen gas. Then, the mixture inside the flask is reacted for 10 hours at 230° C. at normal pressure (101.3 kPa) while being mechanically stirred, and then is reacted for 1 hour at 8 kPa. Then, the mixture is cooled to 210° C. Then, 10 parts by mole of trimellitic anhydride is added to the mixture and this resultant mixture is reacted for 1 hour. Then, this mixture is reacted at 8 kPa until the softening temperature becomes 115° C., whereby amorphous polyester resin (amorphous resin A) is obtained.

The glass transition temperature of the amorphous polyester resin A is 58° C.

Preparation of Amorphous Polyester Resin Particle Dispersion Liquid A 500 parts by weight of an amorphous polyester resin A, 300 parts by weight of methyl ethyl ketone, 100 parts by weight of isopropyl alcohol, and 5.0 parts by weight of 10 wt % ammonia aqueous solution are put into a separable flask to mix these and dissolve the resultant mixture. Then, ion-exchanged water is added dropwise with a liquid feeding pump while heating and stirring the resultant material at 50° C. Then, a solvent is removed under reduced pressure. Then, after 50 parts by weight of 20 wt % sodium dodecylbenzenesulfonate aqueous solution is added to the solvent-free amorphous polyester resin particle dispersion liquid, ion-exchanged water is added thereto to adjust concentration of a solid content to 40% by weight, whereby amorphous polyester resin particle dispersion liquid A is obtained. A volume-average particle size of the obtained polyester resin particles is 220 nm.

Synthesis of Amorphous Polyester Resin B

Polyester Resin not Having Ethylenic Unsaturated Double Bond 60 parts by mole of bisphenol A propylene oxide 2-mole adduct, 40 parts by mole of bisphenol A ethylene oxide 2-mole adduct, 40 parts by mole of terephthalic acid, 50 parts by mole of dodecenylsuccinic acid, and 0.1 part by mole of dibutyltin oxide are put into a heated and dried three-necked flask, and the internal pressure of the flask is decreased through a reduced pressure operation, and then the inside of the flask is set to an inert atmosphere with nitrogen gas. Then, the mixture inside the flask is reacted for 10 hours in 230° C. at normal pressure (101.3 kPa) while being mechanically stirred, and then is reacted for 1 hour at 8 kPa. Then, the mixture is cooled to 210° C. Then, 10 parts by mole of trimellitic anhydride is added to the mixture and this resultant mixture is reacted for 1 hour. Then, this mixture is reacted at 8 kPa until the softening temperature becomes 115° C., whereby amorphous polyester resin (amorphous resin B) is obtained.

The glass transition temperature of the amorphous polyester resin B is 52° C.

Preparation of Amorphous Polyester Resin Particle Dispersion Liquid B 500 parts by weight of an amorphous polyester resin B, 350 parts by weight of methyl ethyl ketone, 200 parts by weight of isopropyl alcohol, and 5.0 parts by weight of 10 wt % ammonia aqueous solution are put into a separable flask to mix these and dissolve the resultant mixture. Then, ion-exchanged water is added dropwise with a liquid feeding pump while heating and stirring the resultant material at 50° C. Then, a solvent is removed under reduced pressure. Then, after 50 parts by weight of aqueous solution of 20 wt % sodium dodecylbenzenesulfonate is added to the solvent-free amorphous polyester resin particle dispersion liquid, ion-exchanged water is added thereto to adjust concentration of a solid content to 40% by weight, whereby amorphous polyester resin particle dispersion liquid B is obtained. A volume-average particle size of the obtained amorphous polyester resin particles is 203 nm.

Synthesis of Amorphous Polyester Resin C

Polyester Resin not Having Ethylenic Unsaturated Double Bond 80 parts by mole of bisphenol A propylene oxide 2-mole adduct, 20 parts by mole of bisphenol A ethylene oxide 2-mole adduct, 75 parts by mole of terephthalic acid, 15 parts by mole of dodecenylsuccinic acid, and 0.1 part by mole of dibutyltin oxide are put into a heated and dried three-necked flask, and the internal pressure of the flask is decreased through a reduced pressure operation, and then the inside of the flask is set to an inert atmosphere with nitrogen gas. Then, the mixture inside the flask is reacted for 10 hours at 230° C. at normal pressure (101.3 kPa) while being mechanically stirred, and then is reacted for 1 hour at 8 kPa. Then, the mixture is cooled to 210° C. Then, 10 parts by mole of trimellitic anhydride is added to the mixture and this resultant mixture is reacted for 1 hour. Then, this mixture is reacted at 8 kPa until the softening temperature becomes 115° C., whereby amorphous polyester resin (amorphous resin C) is obtained.

The glass transition temperature of the amorphous polyester resin C is 63° C.

Preparation of Amorphous Polyester Resin Particle Dispersion Liquid C 500 parts by weight of an amorphous polyester resin C, 300 parts by weight of methyl ethyl ketone, 100 parts by weight of isopropyl alcohol, and 5.0 parts by weight of 10 wt % ammonia aqueous solution are put into a separable flask to mix these and dissolve the resultant mixture. Then, ion-exchanged water is added dropwise with a liquid feeding pump while heating and stirring the resultant material at 50° C. Then, a solvent is removed under reduced pressure. Then, after 50 parts by weight of 20 wt % sodium dodecylbenzenesulfonate aqueous solution is added to the solvent-free amorphous polyester resin particle dispersion liquid, ion-exchanged water is added thereto to adjust concentration of a solid content to 40% by weight, whereby amorphous polyester resin particle dispersion liquid C is obtained. A volume-average particle size of the obtained polyester resin particles is 203 nm.

Synthesis of Amorphous Polyester Resin D

Polyester Resin Having Ethylenic Unsaturated Double Bond 80 parts by mole of bisphenol A propylene oxide 2-mole adduct, 20 parts by mole of bisphenol A ethylene oxide 2-mole adduct, 50 parts by mole of terephthalic acid, 15 parts by mole of dodecenylsuccinic acid, 20 parts by mole of fumaric acid, and 0.1 part by mole of dibutyltin oxide are put into a heated and dried three-necked flask, and the internal pressure of the flask is decreased through a reduced pressure operation, and then the inside of the flask is set to an inert atmosphere with nitrogen gas. Then, the mixture inside the flask is reacted for 10 hours at 230° C. at normal pressure (101.3 kPa) while being mechanically stirred, and then is reacted for 1 hour at 8 kPa. Then, the mixture is cooled to 210° C. Then, 10 parts by mole of trimellitic anhydride is added to the mixture and this resultant mixture is reacted for 1 hour. Then, this mixture is reacted at 8 kPa until the softening temperature becomes 115° C., whereby amorphous polyester resin (amorphous resin D) is obtained.

The glass transition temperature of the amorphous polyester resin D is 65° C.

Preparation of Amorphous Polyester Resin Particle Dispersion Liquid D 500 parts by weight of an amorphous polyester resin D, 340 parts by weight of methyl ethyl ketone, 100 parts by weight of isopropyl alcohol, and 5.0 parts by weight of 10 wt % ammonia aqueous solution are put into a separable flask to mix these and dissolve the resultant mixture. Then, ion-exchanged water is added dropwise with a liquid feeding pump while heating and stirring the resultant material at 50° C. Then, a solvent is removed under reduced pressure. Then, after 50 parts by weight of 20 wt % sodium dodecylbenzenesulfonate aqueous solution is added to the solvent-free amorphous polyester resin particle dispersion liquid, ion-exchanged water is added thereto to adjust concentration of a solid content to 40% by weight, whereby amorphous polyester resin particle dispersion liquid D is obtained. A volume-average particle size of the obtained polyester resin particles is 182 nm.

Synthesis of Amorphous Polyester Resin E

Polyester Resin Having Ethylenic Unsaturated Double Bond 80 parts by mole of bisphenol A propylene oxide 2-mole adduct, 20 parts by mole of bisphenol A ethylene oxide 2-mole adduct, 10 parts by mole of terephthalic acid, 30 parts by mole of dodecenylsuccinic acid, 50 parts by mole of fumaric acid, and 0.1 part by mole of dibutyltin oxide are put into a heated and dried three-necked flask, and the internal pressure of the flask is decreased through a reduced pressure operation, and then the inside of the flask is set to an inert atmosphere with nitrogen gas. Then, the mixture inside the flask is reacted for 10 hours at 230° C. at normal pressure (101.3 kPa) while being mechanically stirred, and then is reacted for 1 hour at 8 kPa. Then, the mixture is cooled to 210° C. Then, 10 parts by mole of trimellitic anhydride is added to the mixture and this resultant mixture is reacted for 1 hour. Then, this mixture is reacted at 8 kPa until the softening temperature becomes 115° C., whereby amorphous polyester resin (amorphous resin E) is obtained.

The glass transition temperature of the amorphous polyester resin E is 60° C.

Preparation of Amorphous Polyester Resin Particle Dispersion Liquid E 500 parts by weight of an amorphous polyester resin E, 320 parts by weight of methyl ethyl ketone, 125 parts by weight of isopropyl alcohol, and 5.0 parts by weight of 10 wt % ammonia aqueous solution are put into a separable flask to mix these and dissolve the resultant mixture. Then, ion-exchanged water is added dropwise with a liquid feeding pump while heating and stirring the resultant material at 50° C. Then, a solvent is removed under reduced pressure. Then, after 50 parts by weight of 20 wt % sodium dodecylbenzenesulfonate aqueous solution is added to the solvent-free amorphous polyester resin particle dispersion liquid, ion-exchanged water is added thereto to adjust concentration of a solid content to 40% by weight, whereby amorphous polyester resin particle dispersion liquid E is obtained. A volume-average particle size of the obtained amorphous polyester resin particles is 190 nm.

Synthesis of Amorphous Polyester Resin F

Polyester Resin Having Ethylenic Unsaturated Double Bond 100 parts by mole of bisphenol A propylene oxide 2-mole adduct, 70 parts by mole of terephthalic acid, 20 parts by mole of fumaric acid, and 0.1 part by mole of dibutyltin oxide are put into a heated and dried three-necked flask, and the internal pressure of the flask is decreased through a reduced pressure operation, and then the inside of the flask is set to an inert atmosphere with nitrogen gas. Then, the mixture inside the flask is reacted for 10 hours at 230° C. at normal pressure (101.3 kPa) while being mechanically stirred, and then is reacted for 1 hour at 8 kPa. Then, the mixture is cooled to 210° C. Then, 10 parts by mole of trimellitic anhydride is added to the mixture and this resultant mixture is reacted for 1 hour. Then, this mixture is reacted at 8 kPa until the softening temperature becomes 115° C., whereby amorphous polyester resin (amorphous resin F) is obtained.

The glass transition temperature of the amorphous polyester resin F is 57° C.

Preparation of Amorphous Polyester Resin Particle Dispersion Liquid F 500 parts by weight of an amorphous polyester resin F, 250 parts by weight of methyl ethyl ketone, 100 parts by weight of isopropyl alcohol, 5.0 parts by weight of 10 wt % ammonia aqueous solution are put into a separable flask to mix these and dissolve the resultant mixture. Then, ion-exchanged water is added dropwise with a liquid feeding pump while heating and stirring the resultant material at 50° C. Then, a solvent is removed under reduced pressure. Then, after 50 parts by weight of 20 wt % sodium dodecylbenzenesulfonate aqueous solution is added to the solvent-free amorphous polyester resin particle dispersion liquid, ion-exchanged water is added thereto to adjust concentration of a solid content to 40% by weight, whereby amorphous polyester resin particle dispersion liquid F is obtained. A volume-average particle size of the obtained polyester resin particles is 172 nm.

Synthesis of Crystalline Polyester Resin 44 parts by mole of 1,9-nonanediol, 56 parts by mole of dodecanedicarboxylic acid, and 0.05 part by mole of dibutyltin oxide are put into a heated and dried three-necked flask, and then nitrogen gas is introduced into the container to maintain an inert atmosphere and a temperature is raised. Then, co-condensation polymerization reaction is performed for 2 hours at 150° C. to 230° C., and then a temperature is gradually raised to 230° C., and the resultant mixture is stirred for 5 hours, whereby the mixture enters a viscous state. Then, the mixture is cooled with air and the reaction is stopped, whereby a crystalline polyester resin is synthesized.

Preparation of Crystalline Polyester Resin Particle Dispersion Liquid 3,000 parts by weight of the crystalline polyester resin that is obtained, 10,000 parts by weight of ion-exchanged water, and 60 parts by weight of the sodium dodecylbenzenesulfonate are put into an emulsifying tank of a high-temperature and high-pressure emulsifying device (CAVITRON CD1010), and the resultant mixture is heated and melted at 130° C. and is dispersed with a flow rate of 3 L/m for 30 minutes at 110° C. at 10,000 rpm. Then, the resultant material is made to pass through a cooling tank to prepare a crystalline polyester resin particle dispersion liquid in which a solid content is 40% by weight and a volume-average particle size D50v is 125 nm.

Preparation of Colorant Dispersion Liquid 50 parts by weight of carbon black (Regal 330, manufactured by CABOT Co.), 2.5 parts by weight of ionic surfactant Neogen R (manufactured by Dai-Ichi Kogyo Seiyaku Co., Ltd.), and 150 parts by weight of ion-exchanged water are mixed and dissolved, and then the resultant material is dispersed for ten minutes by a homogenizer (IKA ULTRA-TURRAX), and then is subjected to a dispersion treatment by ULTIMIZER. Then, the resultant dispersed material is adjusted with ion-exchanged water to have 30% by weight of solid content, whereby a colorant dispersion liquid having a central particle size of 245 nm is obtained.

Preparation of Release Agent dispersion liquid 50 parts by weight of paraffin wax (HNP0190, manufactured by Nippon Seiro Co., Ltd.), 2.5 parts by weight of ionic surfactant Neogen R (manufactured by Dai-Ichi Kogyo Seiyaku Co., Ltd.), and 150 parts by weight of ion-exchanged water are heated at 120° C., and the resultant material is subjected to a dispersion treatment using a pressure-injection type Gaulin homogenizer. Then, the resultant material is adjusted with ion-exchanged water to have 30% by weight of solid content, whereby a release agent dispersion liquid having a central particle size of 219 nm is obtained.

Example 1

Preparation of Toner 1

638 parts by weight of the amorphous polyester resin particle dispersion liquid A, 128 parts by weight of crystalline polyester resin particle dispersion liquid, 88 parts by weight of colorant dispersion liquid, 175 parts by weight of release agent dispersion liquid, 2.5 parts by weight of aluminum sulfate (manufactured by Wako Pure Chemical Industries, Ltd.), 50 parts by weight of 0.3 M nitric acid aqueous solution, and 2050 parts by weight of ion-exchanged water are put into a three-liter reaction vessel provided with a thermometer, a pH meter, and a stirrer, and the resultant mixture is left for 30 minutes under conditions in which a temperature is 30° C. and the number of stirring rotations is 150 rpm while controlling a temperature with a mantle heater from the outside.

25 parts by weight of 10 wt % aluminum sulfate aqueous solution is added to the resultant material while performing dispersion treatment using a homogenizer (ULTRA TUR- RAX T50, manufactured by IKA NIPPON Co.). Then, 0.3 N nitric acid aqueous solution is added to the resultant material to adjust pH in the aggregation process to 3.5. Then, a temperature is raised to 50° C., and a particle size is measured with a COULTER MULTISIZER II (an aperture diameter: 100 μm, manufactured by Beckman Coulter, Inc.), and whereby aggregates having a volume-average particle size of 5.5 μm are obtained.

Next, 255 parts by weight of amorphous polyester resin particle dispersion liquid A is additionally added to the resultant material.

Subsequently, 40 parts by weight of 10 wt % NTA (nitrilotriacetic acid) metal salt aqueous solution (CHELEST 70, manufactured by Chelest Co., Ltd.) is added, and pH is adjusted to 9.0 using 1 N sodium hydroxide aqueous solution. Then, a temperature is raised to 80° C. with a rate of temperature increase set to 0.05° C./minute, and then the resultant material is maintained at 80° C. for 3 hours.

100 parts by weight of 10 wt % ammonium persulfate aqueous solution is added to the obtained coalesced particle dispersion liquid. Then, a solution, which is obtained by dissolving 5 parts by weight of amorphous polyester resin D with respect to 20 parts by weight of styrene (St), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until an electrical conductivity of filtrate reaches 20 μS/cm or less, and then the resultant material is vacuum-dried for 5 hours in an oven of 40° C. to obtain toner particles.

1.5 parts by weight of hydrophobic silica (RY50, manufactured by Nippon Aerosil Co.) and 1.0 part by weight of hydrophobic titanium oxide (T805, manufactured by Nippon Aerosil Co.) based on 100 parts by weight of the obtained toner particle are mixed and blended for 30 seconds at 10,000 rpm using a sample mill. Then, the resultant blended material is sieved using a vibrating sieve with an aperture of 45 μm, whereby a toner 1 is prepared.

Preparation of Developer 100 parts by weight of ferrite particles (manufactured by Powder-Tech Associate, Inc., in which a volume-average particle size is 50 μm,) and 1.5 parts by weight of methyl methacrylate resin (manufactured by MITSUBISHI RAYON CO., LTD., in which a proportion of a component having molecular weight of 95,000, 10,000 or less is 5%) together with 500 parts by weight of toluene are put into a pressurizing kneader, and are mixed at room temperature (30° C.) for 15 minutes while being stirred. Then, the resultant mixture is mixed under reduced pressure and is heated to 70° C. to distill toluene off. Then, the resultant material is cooled and is classified using a sieve with an aperture of 105 μm, whereby a resin-coated ferrite carrier is prepared.

This resin-coated ferrite carrier is mixed with the above-described toner 1 to prepare a two-component developer 1 with a toner concentration of 7% by weight.

Evaluation

A blocking property, a lowest fixing temperature, and a transportability of toner are evaluated on the basis of a method to be described below. Results that are obtained are shown in Table 1.

Blocking Property 10 g of toner is weighed on a propylenic cup, and is left as is for 17 hours under an environment of 50° C. and 50% RH, and a blocking (aggregation) state is evaluated on the basis of a standard as follows.

A: When the cup is inclined, the toner flows out

B: When the cup is moved, the toner gradually collapses down and flows out

C: A blocked body is generated, and when colliding with an object having a sharp point, the blocked body collapses down D: A blocked body is generated, and even when colliding with an object having a sharp point, the blocked body is difficult to collapse down Lowest Fixing Temperature The low temperature fixing property (the lowest fixing temperature) is evaluated as follows.

An amount of toner loaded on paper manufactured by Fuji Xerox Co., Ltd. (J paper) is adjusted to 13.5 g/m$^2$ by using a modified product (that is modified to perform fixing using an external fixing device in which a fixing temperature is variable) of a DocuCentre-IV C4300 (manufactured by Fuji Xerox Co., Ltd.) to form a solid toner image. After forming the toner image, this toner image is fixed using an external fixing device under Nip of 6.5 mm and at a fixing rate of 210 mm/sec.

A fixing temperature is raised in steps of 5° C. from 130° C. to fix the toner image. The paper is folded to the inner side at a substantially central portion of the solid portion of the fixed image in the paper, and a portion in which the fixed image is broken is wiped out using tissue paper. A formed white line width is measured and evaluation is performed on the basis of an evaluation standard as follows.

A fixing temperature that is evaluated as B is set as the lowest fixing temperature. The lowest fixing temperature is preferably less than 150° C.

A: The white line width is less than 0.2 mm

B: The white line width is 0.2 mm or more and less than 0.4 mm

C: The white line width is from 0.4 mm to 0.8 mm

D: The white line width exceeds 0.8 mm

Transportability of Toner

The transportability of toner is evaluated as follows.

300 g of toner is put into a color toner cartridge for a DocuCentre-IV C4300 manufactured by Fuji-Xerox Co., Ltd., and this toner cartridge is left as is under a high-temperature and high-humidity environment (45° C., 90% RH) for seven days. Then, the cartridge is made to operate with the toner discharge port opened, and the clogging of a transporting path is evaluated.

A standard of the clogging of the transporting path is as follows.

B: Clogging does not occur

C: Slight clogging occurs

D: Clogging occurs

Example 2

Preparation of Toner 2

A toner 2 is prepared similarly to the preparation of the toner 1 except that the aggregates are prepared by changing the content of the amorphous polyester resin particle dispersion liquid A to 740 parts by weight, and the content of the additional amorphous polyester resin particle dispersion liquid A is set to 153 parts by weight.

A developer is prepared similarly to Example 1, and evaluation is performed similarly to Example 1. Results that are obtained are shown in Table 1.

Example 3

Preparation of Toner 3

Next, a toner 3 is prepared similarly to the preparation of the toner 1 except that aggregates are prepared by changing the amorphous polyester resin particle dispersion liquid B to 446 parts by weight instead of amorphous polyester resin particle dispersion liquid A, and by changing the content of the ion-exchanged water to 2110 parts by weight, the content of the additional amorphous polyester resin particle dispersion liquid D is set to 446 parts by weight.

A developer is prepared similarly to Example 1, and evaluation is performed similarly to Example 1. Results that are obtained are shown in Table 1.

Example 4

Preparation of Toner 4

A toner 4 and a developer are prepared similarly to Example 1 except that the amorphous polyester resin particle dispersion liquid A is changed to amorphous polyester resin particle dispersion liquid C, and the additional amorphous polyester resin particle dispersion liquid A is changed to amorphous polyester resin particle dispersion liquid B. Evaluation is performed similarly to Example 1. Results that are obtained are shown in Table 1.

Example 5

Preparation of Toner 5

A toner 5 and a developer are prepared similarly to Example 1 except that the amorphous polyester resin D is changed to the amorphous polyester resin E. Evaluation is performed similarly to Example 1. Results that are obtained are shown in Table 1.

Example 6

Preparation of Toner 6

A toner 6 is prepared similarly to the preparation of toner 1 except that aggregates are prepared by changing the content of the amorphous polyester resin particle dispersion liquid A to 510 parts by weight and the content of the ion-exchanged water to 2178 parts by weight, the content of the additional amorphous polyester resin particle dispersion liquid E is set to 255 parts by weight, and the amorphous polyester resin E is used in place of the amorphous polyester resin D.

A developer is prepared similarly to Example 1, and evaluation is performed similarly to Example 1. Results that are obtained are shown in Table 1.

Example 7

Preparation of Toner 7

A coalesced particle dispersion liquid is prepared similarly to the preparation of toner 1 except that aggregates are prepared by changing the content of the amorphous polyester resin particle dispersion liquid A to 698 parts by weight and the content of the ion-exchanged water to 2178 parts by weight.

100 parts by weight of 10 wt % ammonium persulfate aqueous solution is added to the obtained coalesced particle dispersion liquid. Then, a solution, which is obtained by dissolving 0.25 part by weight of amorphous polyester resin D with respect to 1.0 part by weight of styrene (St), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles.

The hydrophobic silica and the hydrophobic titanium oxide are prepared with respect to the obtained toner particles by the same method as for the toner 1, whereby a toner 7 is obtained.

A developer is prepared similarly to Example 1, and evaluation is performed similarly to Example 1. Results that are obtained are shown in Table 1.

Example 8

Preparation of Toner 8

A coalesced particle dispersion liquid is prepared by the same method as for the toner 1 except that the content of the ion-exchanged water is changed to 2178 parts by weight.

100 parts by weight of 10 wt % ammonium persulfate aqueous solution is added to the obtained coalesced particle dispersion liquid. Then, a solution, which is obtained by dissolving 11.25 parts by weight of amorphous polyester resin D with respect to 13.75 parts by weight of styrene (St), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 8 is obtained.

A developer is prepared similarly to Example 1, and evaluation is performed similarly to Example 1. Results that are obtained are shown in Table 1.

Example 9

Preparation of Toner 9

A coalesced particle dispersion liquid is prepared by the same method as for the toner 1 except that the content of the ion-exchanged water is changed to 2178 parts by weight.

100 parts by weight of 10 wt % ammonium persulfate aqueous solution is added to the obtained coalesced particle dispersion liquid. Then, a solution, which is obtained by dissolving 1.25 parts by weight of amorphous polyester resin D with respect to 23.75 parts by weight of styrene (St), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 9 is obtained.

A developer is prepared similarly to Example 1, and evaluation is performed similarly to Example 1. Results that are obtained are shown in Table 1.

Example 10

Preparation of Toner 10

A coalesced particle dispersion liquid is prepared by the same method as for the toner 1 except that the content of the ion-exchanged water is changed to 2178 parts by weight.

100 parts by weight of 10 wt % ammonium persulfate aqueous solution is added to the obtained coalesced particle dispersion liquid. Then, a solution, which is obtained by dissolving 1.25 parts by weight of amorphous polyester resin D with respect to 19.0 parts by weight of styrene (St) and 4.75 parts by weight of butyl acrylate (BA), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 10 is obtained.

A developer is prepared similarly to Example 1, and evaluation is performed similarly to Example 1. Results that are obtained are shown in Table 1.

Example 11

Preparation of Toner 11

A coalesced particle dispersion liquid is prepared by the same method as for the toner 1 except that the content of the ion-exchanged water is changed to 2178 parts by weight.

100 parts by weight of 10 wt % ammonium persulfate aqueous solution is added to the obtained coalesced particle dispersion liquid. Then, a solution, which is obtained by dissolving 1.25 parts by weight of amorphous polyester resin D with respect to 23.75 parts by weight of divinyl benzene, is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 11 is obtained.

A developer is prepared similarly to Example 1, and evaluation is performed similarly to Example 1. Results that are obtained are shown in Table 1.

Example 12

Preparation of Toner 12

A coalesced particle dispersion liquid is prepared by the same method as for the toner 1 except that the content of the ion-exchanged water is changed to 2178 parts by weight.

100 parts by weight of 10 wt % ammonium persulfate aqueous solution is added to the obtained coalesced particle dispersion liquid. Then, a solution, which is obtained by dissolving 1.25 parts by weight of amorphous polyester resin D with respect to 19.0 parts by weight of styrene (St) and 4.75 parts by weight of methyl methacrylate (MMA), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 12 is obtained.

A developer is prepared similarly to Example 1, and evaluation is performed similarly to Example 1. Results that are obtained are shown in Table 1.

Example 13

Preparation of Toner 13

A toner 13 and a developer are prepared similarly to Example 1 except that the additional amorphous polyester resin particle dispersion liquid A is changed to the amorphous polyester resin particle dispersion liquid F. Evaluation is performed similarly to Example 1. Results that are obtained are shown in Table 1.

Example 14

Preparation of Toner 14

A toner 14 and a developer are prepared similarly to Example 1 except that the amorphous polyester resin particle dispersion liquid A is changed to amorphous polyester resin particle dispersion liquid C, the additional amorphous polyester resin particle dispersion liquid A is changed to amorphous polyester resin particle dispersion liquid C, and the amorphous polyester resin D is changed to amorphous polyester resin F. Evaluation is performed similarly to Example 1. Results that are obtained are shown in Table 1.

Example 15

Preparation of Toner 15

A coalesced particle dispersion liquid is prepared by the same method as for the toner 1 except that the content of the amorphous polyester resin particle dispersion liquid A is changed to 446 parts by weight, and the content of the ion-exchanged water is changed to 2178 parts by weight.

100 parts by weight of 10 wt % ammonium persulfate aqueous solution is added to the obtained coalesced particle dispersion liquid. Then, a solution, which is obtained by dissolving 40 parts by weight of amorphous polyester resin E with respect to 60 parts by weight of divinyl benzene, is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 15 is obtained.

A developer is prepared similarly to Example 1, and evaluation is performed similarly to Example 1. Results that are obtained are shown in Table 1.

Example 16

Preparation of Toner 16

A coalesced particle dispersion liquid is prepared by the same method as for the toner 1 except that the content of the ion-exchanged water is changed to 2178 parts by weight.

100 parts by weight of 10 wt % ammonium persulfate aqueous solution is added to the obtained coalesced particle dispersion liquid. Then, a solution, which is obtained by dissolving 17.5 parts by weight of amorphous polyester resin D with respect to 7.5 parts by weight of styrene (St), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 16 is obtained.

A developer is prepared similarly to Example 1, and evaluation is performed similarly to Example 1. Results that are obtained are shown in Table 1.

Comparative Example 1

Preparation of Toner 17

A toner 17 is obtained similarly to the toner 1 except that aggregated particles are prepared by setting the content of the amorphous polyester resin particle dispersion liquid A to 829 parts by weight, and the content of the additional amorphous polyester resin particle dispersion liquid A is changed to 64 parts by weight.

A developer is prepared similarly to Example 1, and evaluation is performed similarly to Example 1. Results that are obtained are shown in Table 2.

Comparative Example 2

Preparation of Toner 18

A toner 18 is obtained similarly to the toner 1 except that aggregated particles are prepared by setting the content of the amorphous polyester resin particle dispersion liquid A to 383 parts by weight, and the content of the additional amorphous polyester resin particle dispersion liquid A is changed to 383 parts by weight.

A developer is prepared similarly to Example 1, and evaluation is performed similarly to Example 1. Results that are obtained are shown in Table 2.

Comparative Example 3

Preparation of Toner 19

100 parts by weight of 10 wt % ammonium persulfate aqueous solution is added to the coalesced particle dispersion liquid that is used in the toner 1. Then, a solution, which is obtained by dissolving 5 parts by weight of amorphous polyester resin A with respect to 20 parts by weight of styrene (St), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 19 is obtained.

A developer is prepared similarly to Example 1, and evaluation is performed similarly to Example 1. Results that are obtained are shown in Table 2.

Comparative Example 4

Preparation of Toner 20

100 parts by weight of 10 wt % ammonium persulfate aqueous solution is added to the coalesced particle dispersion liquid that is used in the toner 1. Then, 25 parts by weight of styrene (St) is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 20 is obtained.

A developer is prepared similarly to Example 1, and evaluation is performed similarly to Example 1. Results that are obtained are shown in Table 2.

Comparative Example 5

Preparation of Toner 21

Aggregated particles are prepared by the same method as for the toner 1 except that the content of the amorphous polyester resin particle dispersion liquid A is set to 701 parts by weight. Then, similarly to the toner 1, the additional amorphous polyester resin particle dispersion liquid A is added.

Subsequently, 40 parts by weight of 10 wt % NTA (nitrilotriacetic acid) metal salt aqueous solution (CHELEST 70, manufactured by CHELEST CO., LTD) is added, and pH is adjusted to 9.0 using 1 N sodium hydroxide aqueous solution. Then, the temperature is raised to 80° C. with a rate of temperature increase set to 0.05° C./minute. Then, the resultant material is maintained at 80° C. for 3 hours, and then is cooled and filtered, whereby coarse toner particles are obtained. The coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 21 is obtained.

A developer is prepared similarly to Example 1, and evaluation is performed similarly to Example 1. Results that are obtained are shown in Table 2.

Comparative Example 6

Preparation of Toner 22

A coalesced particle dispersion liquid is prepared by the same method as the toner 1 except that the content of the amorphous polyester resin particle dispersion liquid A is set to 383 parts by weight.

100 parts by weight of 10 wt % ammonium persulfate aqueous solution is added to the obtained coalesced particle dispersion liquid. Then, a solution, which is obtained by dissolving 25 parts by weight of amorphous polyester resin D with respect to 100 parts by weight of styrene (St), is added to 90 parts by weight of ion-exchanged water in which 25 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 22 is obtained.

A developer is prepared similarly to Example 1, and evaluation is performed similarly to Example 1. Results that are obtained are shown in Table 2.

Comparative Example 7

Preparation of Toner 23

100 parts by weight of 10 wt % ammonium persulfate aqueous solution is added to the coalesced particle dispersion liquid that is used in the toner 1. Then, 25 parts by weight of methyl methacrylate (MMA) is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 23 is obtained.

A developer is prepared similarly to Example 1, and evaluation is performed similarly to Example 1. Results that are obtained are shown in Table 2.

Comparative Example 8

Preparation of Toner 24

100 parts by weight of 10 wt % ammonium persulfate aqueous solution is added to the coalesced particle dispersion liquid that is used in the toner 1. Then, a solution, which is obtained by dissolving 25 parts by weight of amorphous polyester resin C with respect to 100 parts by weight of styrene (St), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 24 is obtained.

A developer is prepared similarly to Example 1, and evaluation is performed similarly to Example 1. Results that are obtained are shown in Table 2.

Comparative Example 9

Preparation of Toner 25

100 parts by weight of 10 wt % ammonium persulfate aqueous solution is added to the coalesced particle dispersion liquid that is used in the toner 1. Then, a solution, which is obtained by dissolving 25 parts by weight of amorphous polyester resin D with respect to 100 parts by weight of methyl methacrylate (MMA), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 25 is obtained.

A developer is prepared similarly to Example 1, and evaluation is performed similarly to Example 1. Results that are obtained are shown in Table 2.

Comparative Example 10

Preparation of Toner 26

A coalesced particle dispersion liquid is obtained by the same method as for the toner 1 except that the additional amorphous polyester resin particle dispersion liquid A is not used.

100 parts by weight of 10 wt % ammonium persulfate aqueous solution is added to the coalesced particle dispersion liquid. Then, a solution, which is obtained by dissolving 25 parts by weight of amorphous polyester resin D with respect to 100 parts by weight of methyl methacrylate (MMA), is added to 90 parts by weight of ion-exchanged water in which 12 parts by weight of 20 wt % dodecylbenzenesulfonic acid aqueous solution is dissolved. Then, an emulsified liquid, which is obtained by performing emulsification for 60 minutes with a disperser, is added dropwise to the coalesced particle dispersion liquid over 30 minutes, and this resultant material is polymerized at 80° C. for 4 hours, and then this resultant material is cooled and filtered to obtain coarse toner particles. The resultant coarse toner particles are dispersed again in ion-exchanged water and are filtered in a repetitive manner to wash the coarse toner particles until electrical conductivity of filtrate reaches 20 μS/cm or less, and then the resultant material is vacuum-dried for 5 hours in an oven of 40° C. to obtain toner particles. The hydrophobic silica and the hydrophobic titanium oxide are prepared by the same method as for the toner 1, whereby a toner 26 is obtained.

A developer is prepared similarly to Example 1, and evaluation is performed similarly to Example 1. Results that are obtained are shown in Table 2.

TABLE 1

| | | | Examples | | | | | | | | |
|---|---|---|---|---|---|---|---|---|---|---|---|
| | | Unit | 1 | 2 | 3 | 4 | 5 | 6 | 7 | 8 | 9 |
| | Toner | — | 1 | 2 | 3 | 4 | 5 | 6 | 7 | 8 | 9 |
| Core portion | Kinds of amorphous polyester resin | — | A | A | B | C | A | A | A | A | A |
| | Tg of amorphous polyester resin | ° C. | 58 | 58 | 52 | 63 | 58 | 58 | 58 | 58 | 58 |
| First shell layer | Kinds of amorphous polyester resin | — | A | A | D | B | A | E | A | A | A |
| | Tg of amorphous polyester resin | ° C. | 58 | 58 | 58 | 52 | 58 | 58 | 58 | 58 | 58 |
| | Proportion of first shell layer | % | 20 | 12 | 35 | 20 | 20 | 20 | 20 | 20 | 20 |
| Second shell layer | Vinyl-based monomer | — | St | St | St | St | St | St | St | St | St |
| | Kinds of amorphous polyester resin | — | D | D | D | D | E | E | D | D | D |
| | Tg of amorphous polyester resin | ° C. | 65 | 65 | 65 | 65 | 60 | 60 | 65 | 65 | 65 |
| | Ratio of vinyl-based monomer/amorphous polyester resin | — | 80/20 | 80/20 | 80/20 | 80/20 | 80/20 | 80/20 | 80/20 | 55/45 | 95/5 |
| | Proportion of second shell layer | % | 5 | 5 | 5 | 5 | 5 | 15 | 0.25 | 5 | 5 |
| | Total amount of shell layers | % | 25 | 17 | 40 | 25 | 25 | 35 | 20.25 | 25 | 25 |

TABLE 1-continued

| | | | | | | | | | | | |
|---|---|---|---|---|---|---|---|---|---|---|---|
| Physical properties of toner | Volume-average particle size | μm | 6.0 | 6.2 | 6.3 | 6.3 | 6.3 | 6.2 | 6.3 | 6.2 | 6.2 |
| | Insoluble fraction of toner | % | 3 | 0.5 | 4.8 | 2.3 | 1.5 | 3.2 | 0.6 | 4.8 | 1.1 |
| Characteristics of toner | Blocking property | — | B | C | B | B | B | B | C | B | C |
| | Lowest fixing temperature | ° C. | 140 | 138 | 145 | 143 | 147 | 146 | 141 | 148 | 139 |
| | Toner transportability | — | B | C | B | B | B | B | B | B | C |

| | | | Examples | | | | | | |
|---|---|---|---|---|---|---|---|---|---|
| | | Unit | 10 | 11 | 12 | 13 | 14 | 15 | 16 |
| | Toner | — | 10 | 11 | 12 | 13 | 14 | 15 | 16 |
| Core portion | Kinds of amorphous polyester resin | — | A | A | A | A | C | A | A |
| | Tg of amorphous polyester resin | ° C. | 58 | 58 | 58 | 58 | 63 | 58 | 58 |
| First shell layer | Kinds of amorphous polyester resin | — | A | A | A | F | C | A | A |
| | Tg of amorphous polyester resin | ° C. | 58 | 58 | 58 | 57 | 63 | 58 | 58 |
| | Proportion of first shell layer | % | 20 | 20 | 20 | 20 | 20 | 20 | 20 |
| Second shell layer | Vinyl-based monomer | — | St/BA = 80/20 | Divinyl benzene | St/MMA = 80/20 | St | St | Divinyl benzene | St |
| | Kinds of amorphous polyester resin | — | D | D | D | D | F | E | D |
| | Tg of amorphous polyester resin | ° C. | 65 | 65 | 65 | 65 | 57 | 60 | 65 |
| | Ratio of vinyl-based monomer/amorphous polyester resin | — | 95/5 | 95/5 | 95/5 | 80/20 | 80/20 | 60/40 | 30/70 |
| | Proportion of second shell layer | % | 5 | 5 | 5 | 5 | 5 | 20 | 5 |
| | Total amount of shell layers | % | 25 | 25 | 25 | 25 | 25 | 40 | 25 |
| Physical properties of toner | Volume-average particle size | μm | 6.2 | 6.2 | 6.2 | 6.2 | 6.3 | 6.3 | 6.2 |
| | Insoluble fraction of toner | % | 1.1 | 1.1 | 1.1 | 12.0 | 2.6 | 18 | 2.2 |
| Characteristics of toner | Blocking property | — | B | A | B | A | C | B | B |
| | Lowest fixing temperature | ° C. | 138 | 148 | 143 | 144 | 138 | 144 | 146 |
| | Toner transportability | — | B | B | B | B | C | B | C |

40

TABLE 2

| | | | Comparative Examples | | | | | | | | | |
|---|---|---|---|---|---|---|---|---|---|---|---|---|
| | | Unit | 1 | 2 | 3 | 4 | 5 | 6 | 7 | 8 | 9 | 10 |
| | Toner | — | 17 | 18 | 19 | 20 | 21 | 22 | 23 | 24 | 25 | 26 |
| Core portion | Kinds of amorphous polyester resin | — | A | A | A | A | A | A | A | A | A | A |
| | Tg of amorphous polyester resin | ° C. | 58 | 58 | 58 | 58 | 58 | 58 | 58 | 58 | 58 | 58 |
| First shell layer | Kinds of amorphous polyester resin | — | A | A | A | A | A | A | A | A | A | — |
| | Tg of amorphous polyester resin | ° C. | 58 | 58 | 58 | 58 | 58 | 58 | 58 | 58 | 58 | — |
| | Proportion of first shell layer | % | 5 | 30 | 20 | 20 | 25 | 20 | 20 | 20 | 20 | — |
| Second shell layer | Vinyl-based monomer | — | St | St | St | St | — | St | MMA | St | MMA | MMA |
| | Kinds of amorphous polyester resin | — | D | D | A | — | — | D | — | C | D | D |
| | Tg of amorphous polyester resin | ° C. | 65 | 65 | 58 | — | — | 65 | — | 63 | 65 | 65 |
| | Ratio of vinyl-based monomer/ amorphous polyester resin | — | 80/20 | 80/20 | 80/20 | 100/0 | — | 80/20 | 100/0 | 80/20 | 80/20 | 80/20 |
| | Proportion of second shell layer | % | 5 | 15 | 5 | 5 | — | 25 | 5 | 5 | 5 | 25 |

TABLE 2-continued

| | | Unit | Comparative Examples 1 | 2 | 3 | 4 | 5 | 6 | 7 | 8 | 9 | 10 |
|---|---|---|---|---|---|---|---|---|---|---|---|---|
| Total amount of shell layers | | % | 10 | 45 | 25 | 25 | 25 | 45 | 25 | 25 | 25 | 25 |
| Physical properties of toner | Volume-average particle size | μm | 6.2 | 6.1 | 6.0 | 6.4 | 6.1 | 6.2 | 6.4 | 6.5 | 6.4 | 6.4 |
| | Insoluble fraction of toner | % | 0.1 | 5.5 | 3.3 | 6.5 | 0.5 | 9.1 | 4.2 | 2.0 | 0.1 | 28.0 |
| Characteristics of toner | Blocking property | — | D | B | D | C | D | A | C | C | D | A |
| | Lowest fixing temperature | ° C. | 135 | 153 | 146 | 152 | 142 | 167 | 146 | 146 | 141 | 178 |
| | Toner transportability | — | D | B | C | C | D | B | D | D | D | B |

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An electrostatic charge image developing toner, each toner particle comprising:

a core portion, a first shell layer, and a second shell layer, wherein the core portion contains a first polyester resin, a colorant, and a release agent, the first shell layer contains a second polyester resin and covers the core portion, the second shell layer contains a polymer of an aromatic vinyl monomer and a third polyester resin having an ethylenic unsaturated double bond that is polymerizable with the aromatic vinyl monomer, and covers the first shell layer, and a total amount of the first shell layer and the second shell layer is within a range of from 16% by weight to 40% by weight of the toner particle.

2. The electrostatic charge image developing toner according to claim 1, wherein the first polyester resin and the second polyester resin are polyester resins that do not have the ethylenic unsaturated double bond that is polymerizable with the aromatic vinyl monomer.

3. The electrostatic charge image developing toner according to claim 1, wherein a proportion of a resin, which is insoluble in tetrahydrofuran, in the toner particles is 5% by weight or less.

4. The electrostatic charge image developing toner according to claim 1, wherein a weight ratio of the aromatic vinyl monomer and the third polyester resin that make up the polymer is 70:30 to 99.5:0.5.

5. The electrostatic charge image developing toner according to claim 1, wherein a weight ratio of the second shell layer is from 0.1% by weight to 15% by weight of the toner particle.

6. The electrostatic charge image developing toner according to claim 1, wherein a weight ratio of the first shell layer and the second shell layer is within a range of from 1:15 to 80:1.

7. The electrostatic charge image developing toner according to claim 1, wherein a glass transition temperature of the third polyester resin is higher than a glass transition temperature of the second polyester resin by 5° C. to 20° C.

8. An electrostatic charge image developer, comprising:

the electrostatic charge image developing toner according to claim 1.

9. The electrostatic charge image developer according to claim 8, wherein in the electrostatic charge image developing toner, a weight ratio of the aromatic vinyl monomer and the third polyester resin that make up the polymer is 70:30 to 99.5:0.5.

10. A toner cartridge, comprising:

a toner accommodating chamber, wherein the electrostatic charge image developing toner according to claim 1 is contained in the toner accommodating chamber.

11. The toner cartridge according to claim 10, wherein in the electrostatic charge image developing toner, a weight ratio of the aromatic vinyl monomer and the third polyester resin that make up the polymer is 70:30 to 99.5:0.5.

12. A process cartridge for an image forming apparatus, the process cartridge comprising:

an image holding member; and a developing unit that develops an electrostatic charge image formed on a surface of the image holding member using a developer and forms a toner image, wherein the developer is the electrostatic charge image developer according to claim 8.

13. The process cartridge for an image forming apparatus according to claim 12, wherein in the electrostatic charge image developing toner, a weight ratio of the aromatic vinyl monomer and the third polyester resin that make up the polymer is 70:30 to 99.5:0.5.

14. An image forming apparatus, comprising:

an image holding member;

a charging unit that charges a surface of the image holding member;

a latent image forming unit that forms an electrostatic charge image on the surface of the image holding member;

a developing unit that develops the electrostatic charge image formed on the surface of the image holding member using a developer and forms a toner image; and a transfer unit that transfers the developed toner image to a transfer medium, wherein the developer is the electrostatic charge image developer according to claim 8.

15. The image forming apparatus according to claim 14, wherein in the electrostatic charge image developing toner, a weight ratio of the aromatic vinyl monomer and the third polyester resin that make up the polymer is 70:30 to 99.5:0.5.

16. An image forming method, comprising:

charging a surface of an image holding member;

forming an electrostatic charge image as a latent image on a surface of the image holding member;

developing the electrostatic charge image that is formed on the surface of the image holding member using a developer and forming a toner image; and transferring the developed toner image to a transfer medium, wherein the developer is the electrostatic charge image developer according to claim 8.

17. The image forming method according to claim 16, wherein in the electrostatic charge image developing toner, a weight ratio of the aromatic vinyl monomer and the third polyester resin that make up the polymer is 70:30 to 99.5:0.5.

18. A method of manufacturing the electrostatic charge image developing toner according to claim 1, the method comprising:

mixing a first polyester resin particle dispersion liquid in which a first polyester resin is dispersed, a colorant dispersion liquid in which a colorant is dispersed, and a release agent dispersion liquid in which a release agent is dispersed to form aggregated particles containing first polyester resin particles, colorant particles, and release agent particles;

mixing a second polyester resin particle dispersion liquid in which a second polyester resin is dispersed and an aggregated particle dispersion liquid containing the aggregated particles to allow the second polyester resin particles to be adhered to surfaces of the aggregated particles so as to form resin-adhered aggregated particles;

coalescing the resin-adhered aggregated particles by heating them to form coalesced particles;

mixing a component containing an aromatic vinyl monomer and a third polyester resin having an ethylenic unsaturated double bond that is polymerizable with the aromatic vinyl monomer, and a coalesced particle dispersion liquid containing the coalesced particles to allow the polymerizable component to be adhered to surfaces of the coalesced particles so as to form adhered coalesced particles; and polymerizing the aromatic vinyl monomer and the third polyester resin contained in the polymerizable component to form a polymer of the polymerizable component on the surfaces of the coalesced particles.

* * * * *